US008836590B2

(12) United States Patent
Marten et al.

(10) Patent No.: US 8,836,590 B2
(45) Date of Patent: Sep. 16, 2014

(54) LOCOMOTIVE MODULAR ANTENNA ARRAY

(75) Inventors: Randy C. Marten, Willow Springs, IL (US); Ryan McKenna, Chicago, IL (US); Scott Swenson, Burr Ridge, IL (US); Frank I. Meler, Downers Grove, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 1100 days.

(21) Appl. No.: 12/814,042

(22) Filed: Jun. 11, 2010

(65) Prior Publication Data

US 2010/0315301 A1 Dec. 16, 2010

Related U.S. Application Data

(60) Provisional application No. 61/186,263, filed on Jun. 11, 2009.

(51) Int. Cl.
*H01Q 1/32* (2006.01)
*H01Q 1/42* (2006.01)
*H01Q 21/06* (2006.01)

(52) U.S. Cl.
CPC ..... *H01Q 1/3275* (2013.01); *H01Q 1/42* (2013.01); *H01Q 21/06* (2013.01)
USPC ..... 343/711; 343/713

(58) Field of Classification Search
CPC ..... H01Q 1/32; H01Q 1/3275; H01Q 1/42; H01Q 21/06
USPC ..... 343/711, 713
See application file for complete search history.

(56) References Cited

U.S. PATENT DOCUMENTS 2,566,491 A 9/1951 Hills
5,216,435 A * 6/1993 Hirata et al. ..... 343/853
(Continued)

FOREIGN PATENT DOCUMENTS

DE 10255549 6/2004
EP 1355375 10/2003
EP 1648049 4/2006

OTHER PUBLICATIONS

Written Opinion of the International Searching Authority for Application PCT/US2010/038352, dated Aug. 19, 2010.*

*Primary Examiner* — Dameon E Levi
*Assistant Examiner* — Jennifer F Hu

(57) ABSTRACT

An antenna array for a body panel of a locomotive is described having a base support including at least a pair of elongated parallel structures forming a channel on the body panel of the locomotive cab. A plurality of removable plates are affixed to the elongated parallel structures for mounting an antenna on each of the removable plates, thereby allowing wiring from each antenna to extend from its respective removable plate through the channel formed by the base support. A junction box situated near the base support forms an enclosure about an aperture formed in the body panel of the locomotive. The junction box includes a plurality of interconnects for connecting wiring of each antenna to wiring of a device in the locomotive. In one embodiment, the junction box is integral to the base support. The integral junction box, base support arrangement may further include a lip formed about its periphery in which a cover mounted thereon. In accordance with another aspect of the present invention, an antenna array is provided for a body panel of a locomotive having a base support including a base support having a plurality of pillars on the body panel of the locomotive cab and a plurality of removable plates being supported by the pillars on the base support for mounting an antenna on each of the removable plates.

18 Claims, 22 Drawing Sheets

(56) References Cited

U.S. PATENT DOCUMENTS

| | | | | |
|---|---|---|---|---|
| 6,900,769 | B2 * | 5/2005 | Schlieber et al. | 343/713 |
| 6,990,322 | B2 | 1/2006 | Harris et al. | |
| 7,436,362 | B2 | 10/2008 | Noro | |
| 2002/0180643 | A1 | 12/2002 | Skladany et al. | |
| 2006/0033669 | A1 | 2/2006 | Dejean | |
| 2006/0290580 | A1 | 12/2006 | Noro et al. | |
| 2007/0171138 | A1 | 7/2007 | Noro | |
| 2008/0111752 | A1 | 5/2008 | Lindackers et al. | |
| 2009/0040121 | A1 | 2/2009 | Rosenberger et al. | |
| 2011/0279337 | A1 | 11/2011 | Corwin et al. | |

* cited by examiner

Prior
Art

Prior
Art

*Fig. 5* *Prior Art*

LOCOMOTIVE MODULAR ANTENNA ARRAY

CROSS-REFERENCE TO RELATED APPLICATIONS

The present patent application is a non-provisional application claiming the benefit under 35 U.S.C. §119(e) of U.S. Provisional Application Ser. No. 61/186,263, filed on Jun. 11, 2009 and entitled "LOCOMOTIVE MODULAR ANTENNA ARRAY," the complete disclosure thereof being incorporated herein by reference.

BACKGROUND OF THE INVENTION

The present invention generally relates to an apparatus for mounting antennas on a locomotive, and more specifically, to a modular antenna array for a locomotive.

FIG. 1 illustrates a locomotive, including a locomotive cab 118. Although FIG. 1 depicts a prior art antenna array 100 mounted to the locomotive cab roof 106, the present invention modular antenna array may be affixed or otherwise mounted to the locomotive cab roof instead.

FIG. 2 illustrates a prior art locomotive having a plurality of antennas 102A-H mounted on the roof 106 of the locomotive cab 118. The antennas 102A-E may comprise different types of antennas, including but not limited to a cellular antenna 102A, a distributed power antenna 102B, a tri-band antenna 102C, a GPS antenna 102D, a head of train antenna, WIFI or WLAN antenna 102E, data radio antenna (e.g., a 220 MHz antenna) 102F, an end of train antenna 102G, voice radio antenna (e.g., VHF voice antenna) 102H, a digital cellular antenna, a GSM-R antenna, electronic train management antenna, or the like. In mounting an antenna to the locomotive cab roof 106, a hole is drilled to accommodate the wiring and/or a portion of the antenna body. The wiring is fed through the hole into the locomotive cab, where it is connected to a device for utilization of that particular antenna. The body of the antenna 102 is affixed to the roof 106 of the locomotive cab 118 by use of fasteners, epoxy, or the like.

However, this prior art system has several shortcomings. For example, each antenna cannot easily be arranged or rearranged in order to overcome communication or RF interference with other antennas. Additionally, because the roof of the locomotive is susceptible to harsh environmental conditions, the prior art system and the locomotive cab is susceptible to water ingress due to deterioration of the joint (e.g., fastener, epoxy, room temperature vulcanizing (RTV), etc.) between the body and antenna, and/or the locomotive roof. The replacement or addition of an antenna in this prior art system also proves to be difficult and labor intensive. Replacement of the antenna first requires the removal of the deteriorated joint and all of the wiring extending from the previous antenna to the device associated therewith, which is typically located in the locomotive cab. Then, new wiring is fed into the locomotive cab, where it is connected to a device for utilization of that particular antenna. The body of the antenna is ultimately affixed to the roof of the locomotive cab using a fastener, epoxy or the like.

FIGS. 3-5 illustrate another prior art system for mounting a plurality of antennas 202(A-F) to a locomotive cab roof 206. In this system, a metal base plate 214 is affixed to the locomotive cab roof 206 using a plurality of fasteners 210 and RTV to prevent water ingress. The metal base plate 214 accommodates a raised antenna mount 204 and a cover (or radome) 208 for the mount. In this arrangement, the raised antenna mount 204 and the cover 208 are affixed to the metal base plate 214. The raised antenna mount 204 accommodates a plurality of antennas 202A-F. The wiring 212, as shown in FIG. 5, for the antennas 202A-F is fed through an aperture defined in the metal base plate 208, through an aperture defined in the roof 206 of the locomotive cab 218, and terminates in the locomotive cab 218 generally at the devices associated therewith, as shown in FIG. 5. The wiring 216 used with the antenna mount 204 is a crimp style connection, which includes fluctuations in the resistance of the connector.

Like the prior art system of FIG. 2, the prior art system of FIGS. 3-5 has several shortcomings. For example, each antenna 202 cannot be easily arranged or rearranged in order to overcome communication or RF interference with other antennas. Moreover, the management of the wiring 212 from each antenna to their respective devices is cumbersome. Additionally, because the roof 206 of the locomotive is susceptible to harsh environmental conditions, the prior art system and the locomotive cab become susceptible to water ingress due to deterioration of the fasteners 210 and RTV of the metal base plate 214, raised antenna mount 204, and cover 208. The replacement of an antenna 202 in this prior art system also proves to be difficult and labor intensive. Replacement of the antenna 202 first requires the removal of the deteriorated fasteners 210 at the cover 208 and the entire antenna mount 204. Also, all of the wiring 212 extending from the previous antenna to the device associated therewith must be removed. Then, new wiring 212 is fed into the locomotive cab 218 via the wire connection arrangement 216, where it is connected to a device for utilization of that particular antenna 202. The antenna 202 is affixed to the antenna mount 204, the entire antenna mount is reaffixed to the metal base plate 214, and the cover 208 is reaffixed to the metal base plate 214.

Accordingly, it is an object of the present invention to provide an antenna mounting apparatus that minimizes water ingress into the cab of a locomotive. It is also an object of the present invention to provide an antenna mounting apparatus that provides easy arrangement and/or rearrangement of the antenna in order to overcome RF interference with other antenna. It is an object of the present invention to provide an apparatus for managing the wiring near each antenna. Finally, it is an object of the present invention to provide an antenna mounting apparatus which is modular and provides for easy maintenance and replacement of a single antenna in a multiple antenna system.

SUMMARY OF THE INVENTION

In accordance with the present invention, provided is an antenna array for a body panel of a locomotive having a base support including at least a pair of elongated parallel structures. A plurality of removable plates are affixed to the elongated parallel structures for mounting an antenna on each of the removable plates, thereby allowing wiring from each antenna to extend from its respective removable base support. A junction box situated near the base support forms an enclosure about an aperture formed in the body panel of the locomotive. The junction box includes a plurality of interconnects for connecting wiring of each antenna to wiring of a device in the locomotive.

In accordance with the present invention, an antenna array is proved for a body panel of a locomotive having a base support including a base support having a plurality of pillars on the body panel of the locomotive cab and a plurality of removable plates being supported by the pillars on the base support for mounting an antenna on each of the removable plates.

It should be understood that the present invention includes a number of different aspects and/or features which may have utility alone and/or in combination with other aspects or features. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

DETAILED DESCRIPTION

Figure 1:
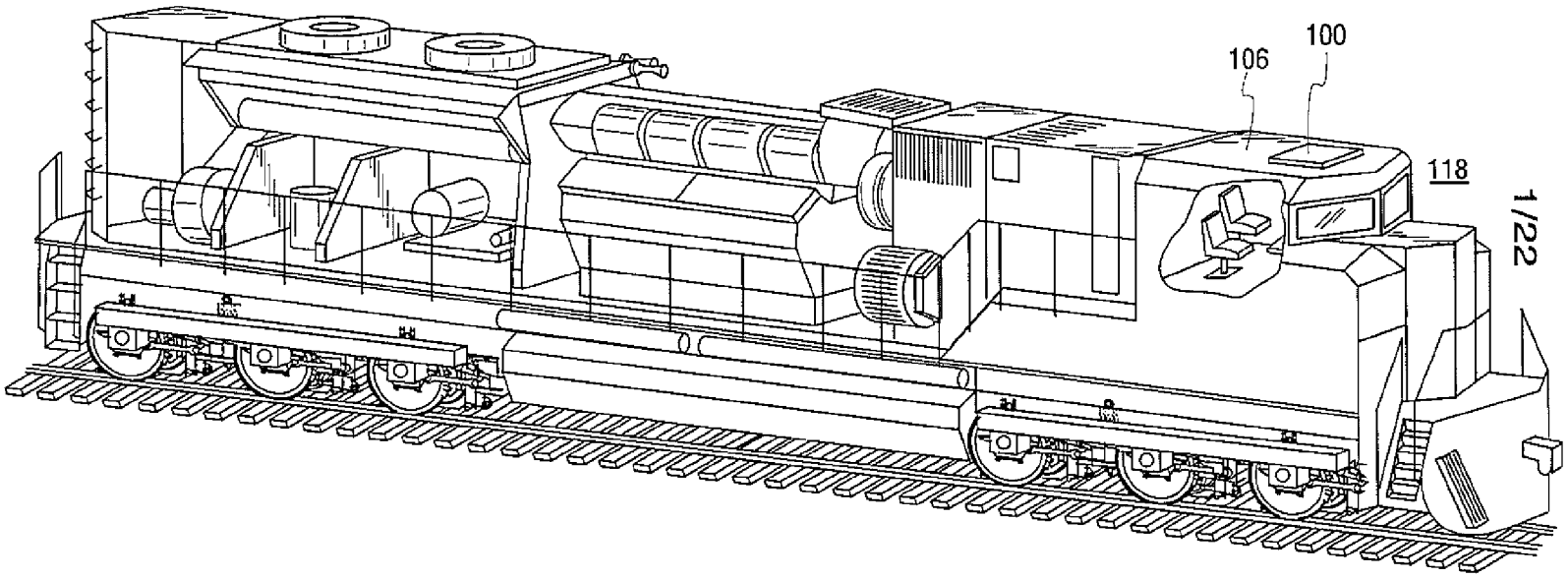
FIG. 1 is perspective view of a locomotive.
Figure 2:
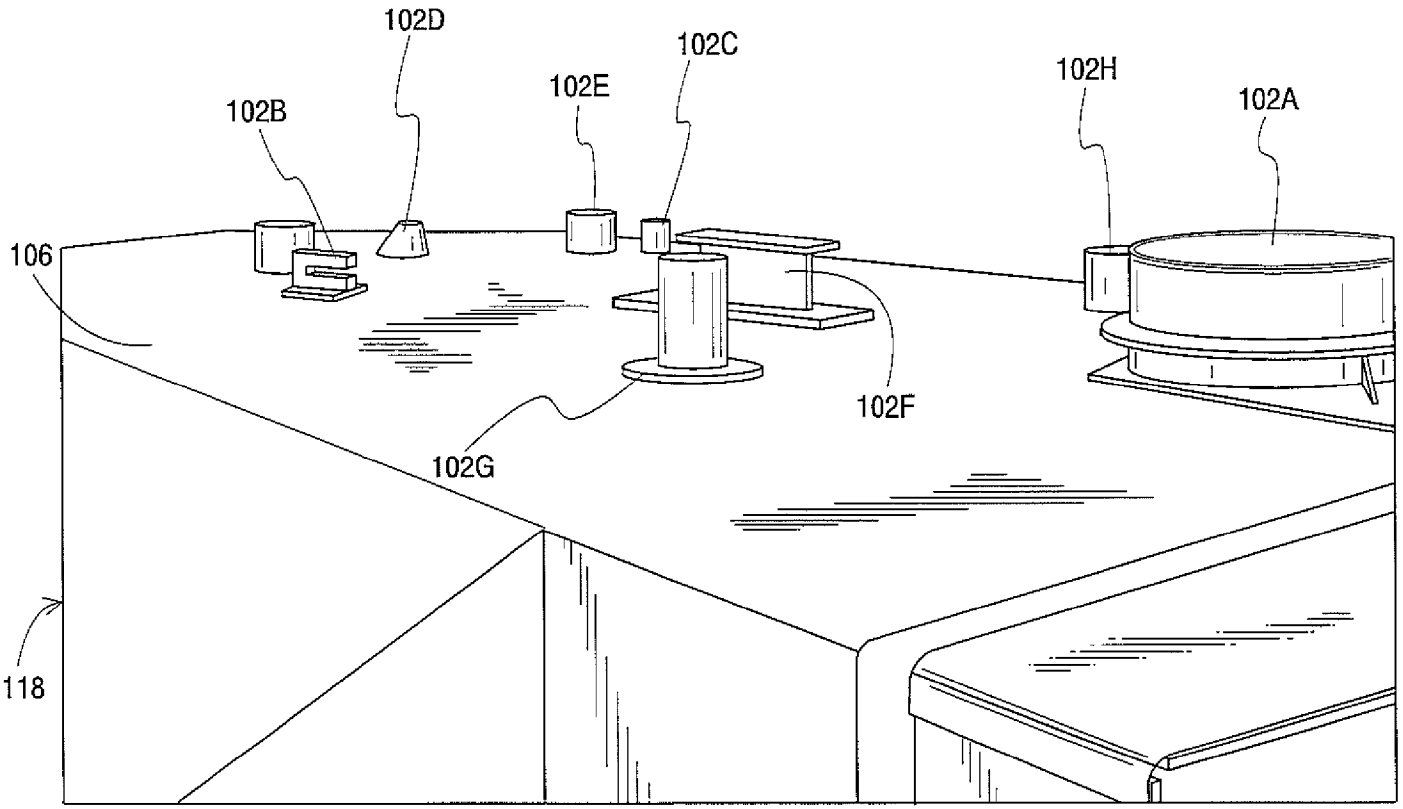
Fig. 2 Prior Art
FIG. 2 is top view of a prior art system for mounting antennas on a locomotive.
Figure 3:
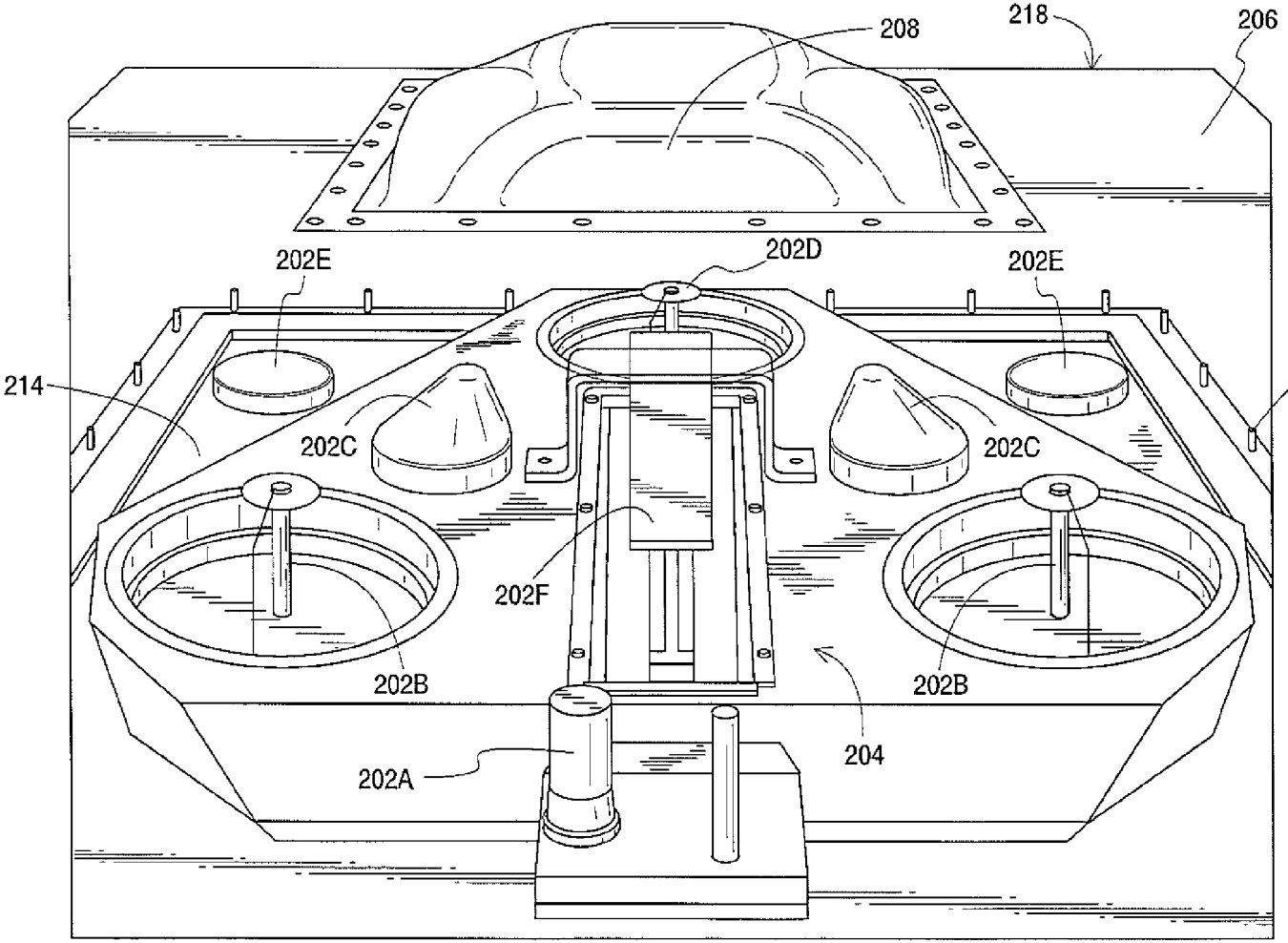
FIG. 3 is a perspective view of a prior art antenna array mounted to a locomotive.
Figure 4:
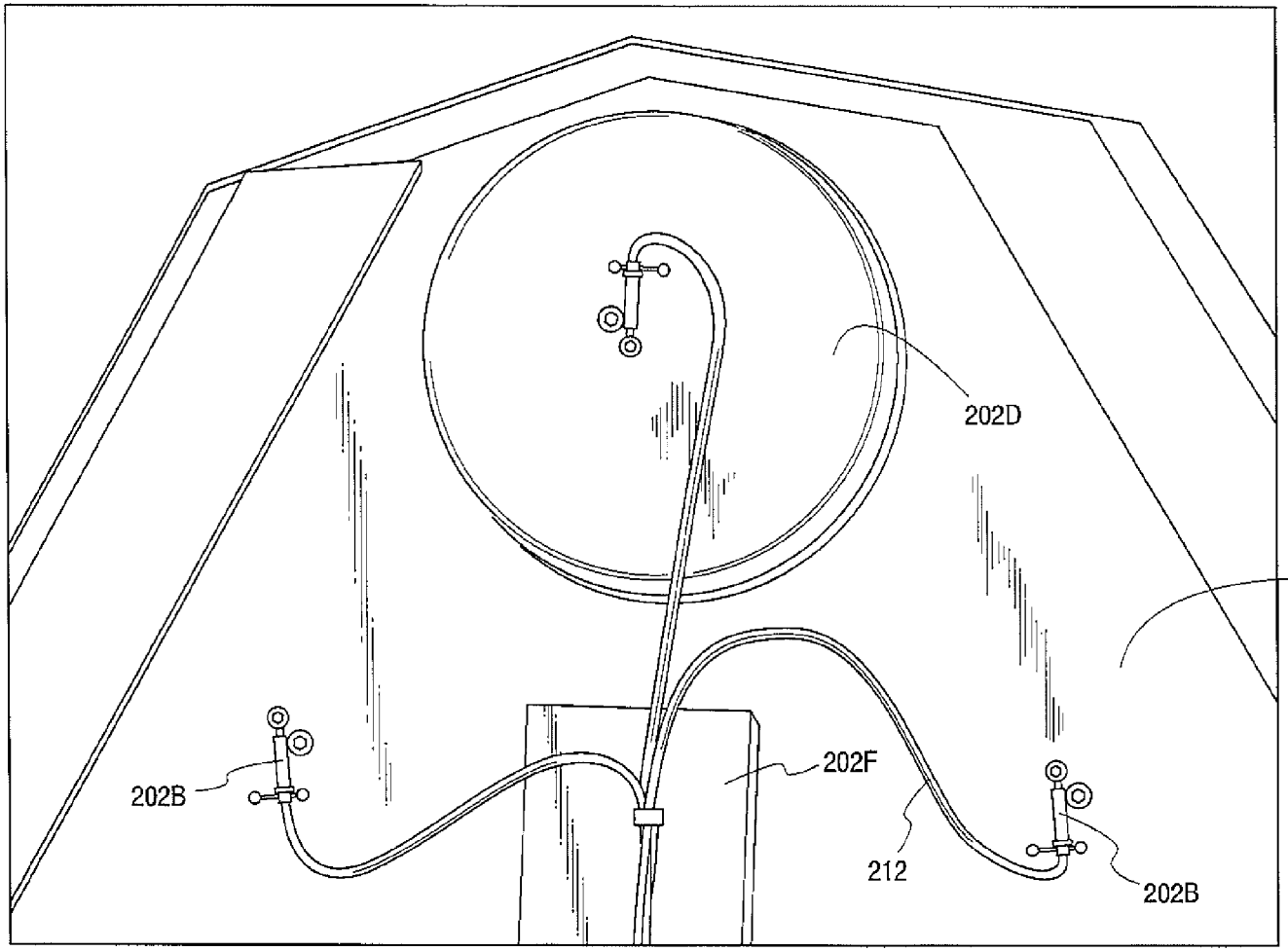
FIG. 4 is a bottom view of the prior art antenna array of FIG. 3.
Figure 5:
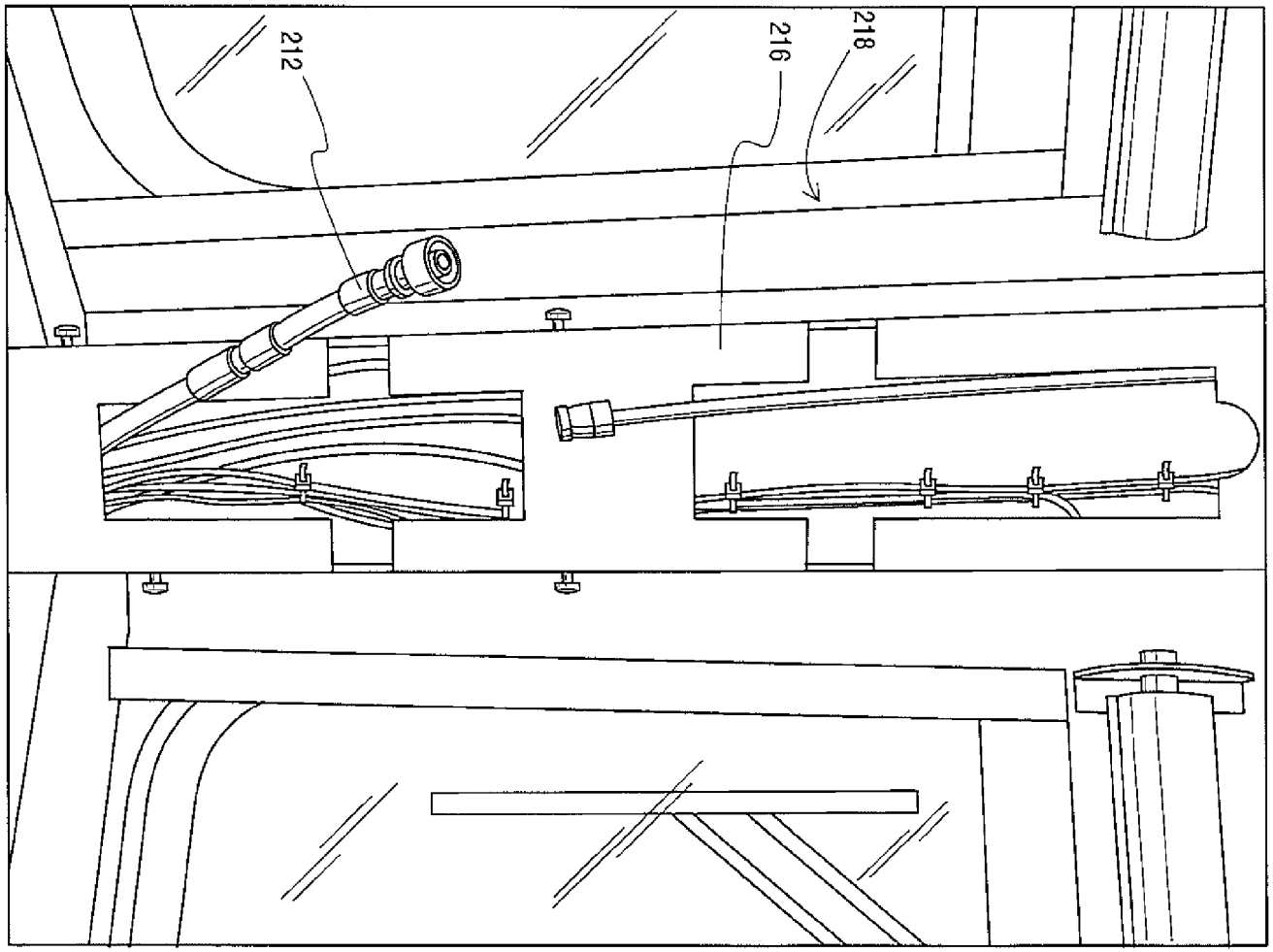
FIG. 5 is a side view of the devices within the locomotive cab associated with the prior art antenna array of FIG. 3.
Figure 6:
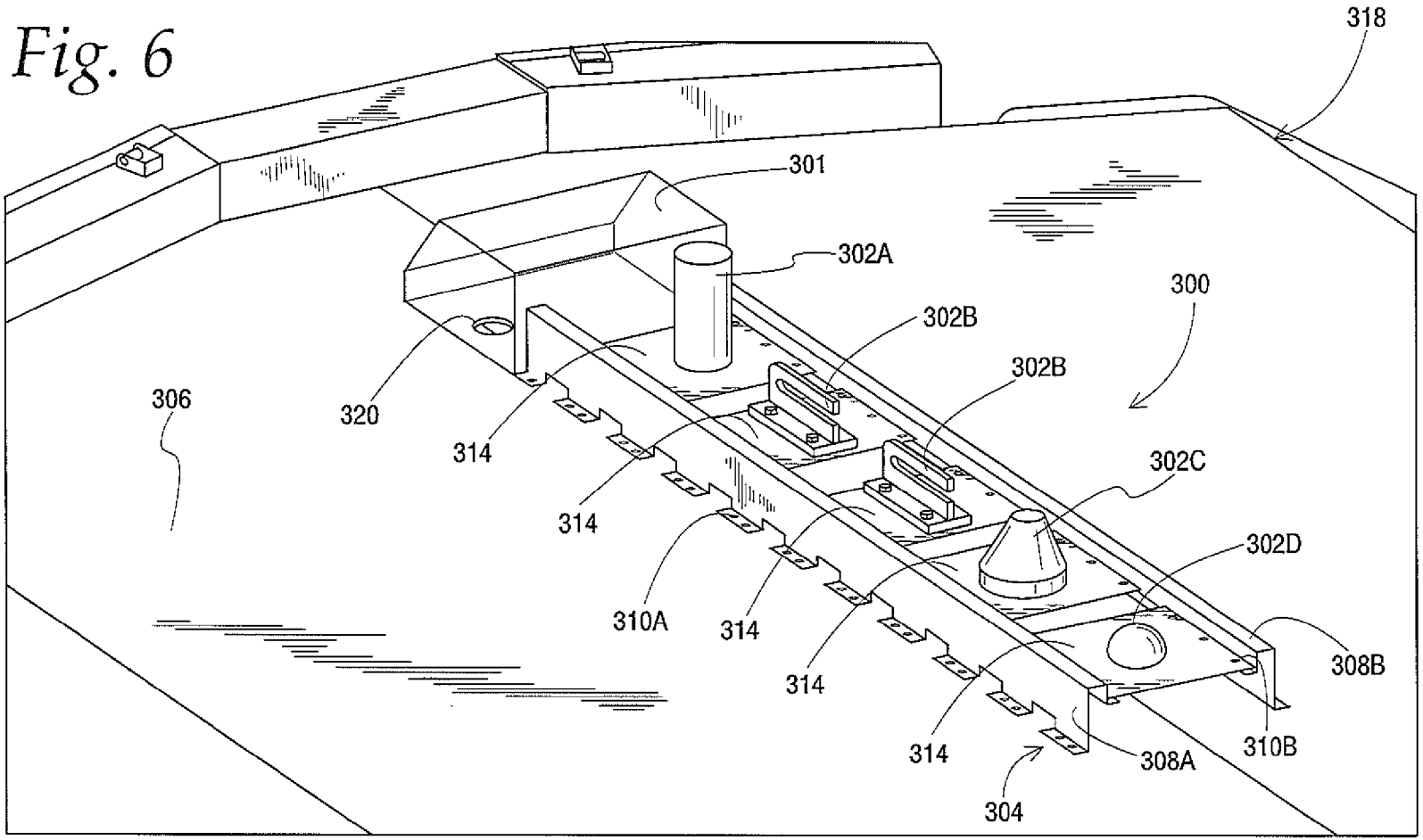
FIG. 6 is a perspective top view of a locomotive cab including the first embodiment of the present invention modular antenna array.
Figure 7:
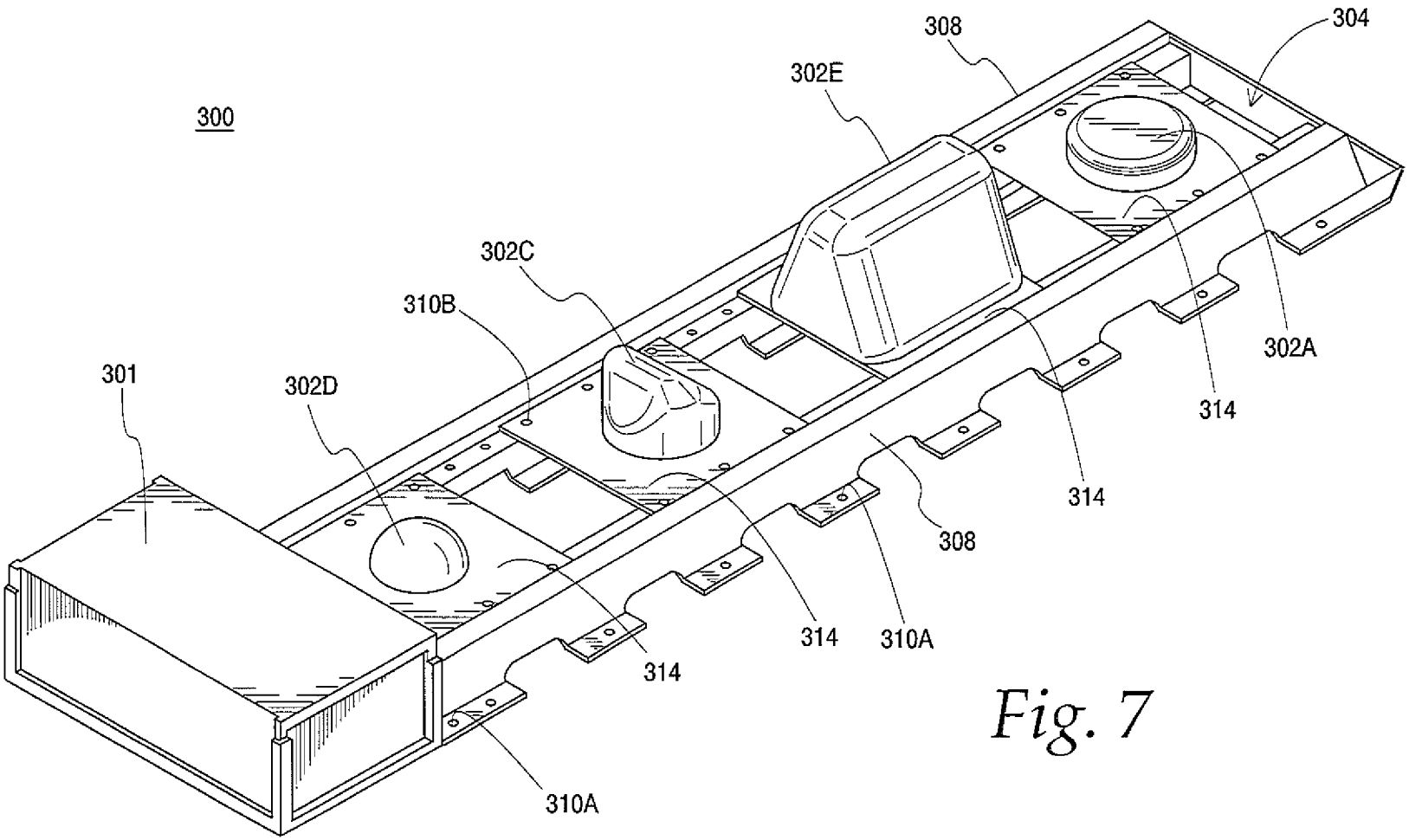
FIG. 7 is a top perspective view of the embodiment of the present invention modular antenna array of FIG. 6.
Figure 8:
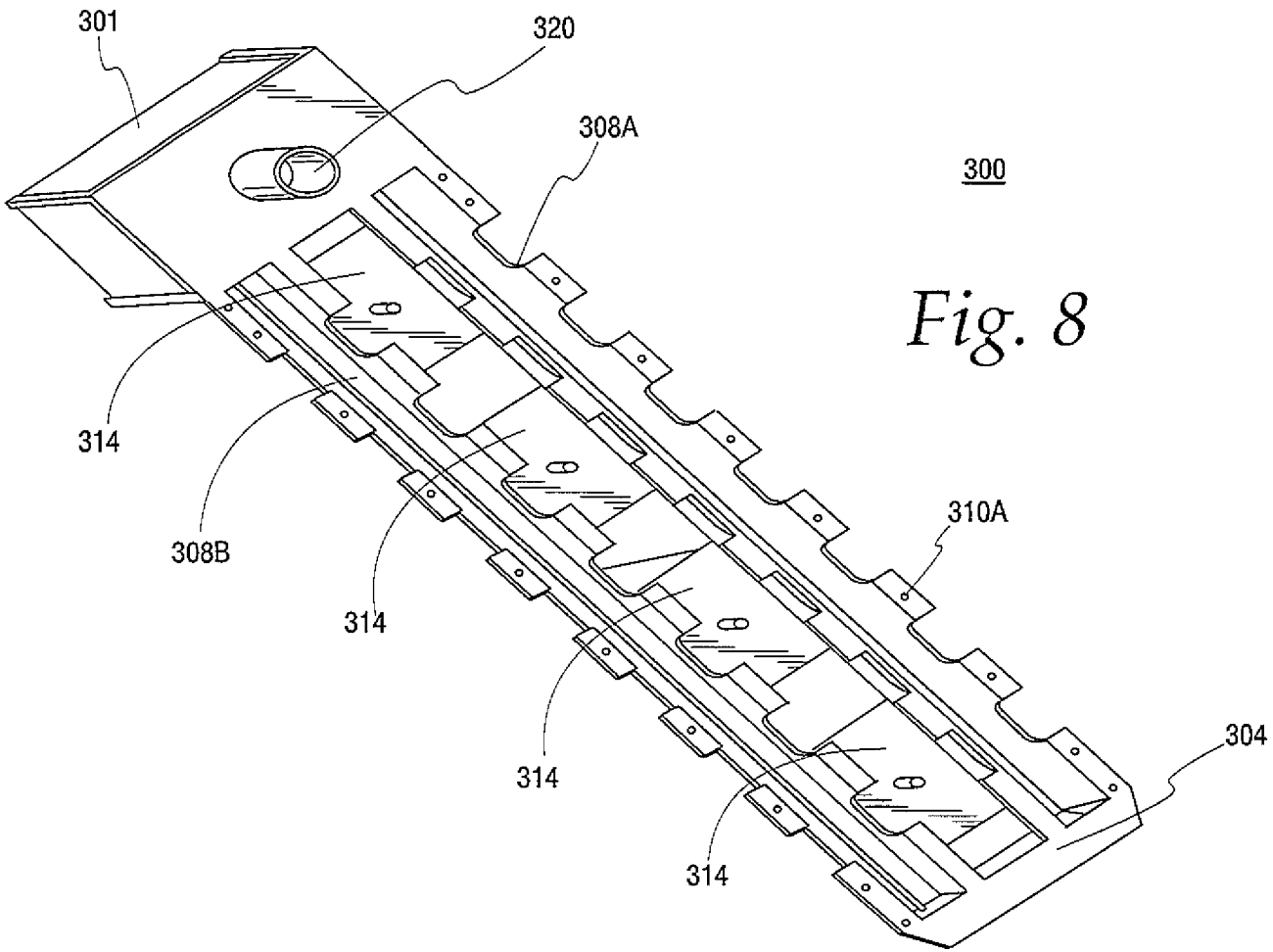
FIG. 8 is a bottom perspective view of the first embodiment of the present invention modular antenna array.

FIGS. 6 through 8 illustrate a first embodiment of the present invention modular antenna array 300 system. This system generally includes a modular antenna array 300 including a base support 304 having a pair of rails 308*a, b* situated in parallel to one another. The base support 304 may be affixed to the roof 306 of the locomotive cab 318 or any other body panel of a locomotive using a variety of fastening means 310A, including but not limited to welding, epoxy, mechanical fasteners, room temperature vulcanizing (RTV), or the like. Situated between the parallel rails 308 is a plurality of removable plates 314, each being adapted to affix an antenna 302 thereto. Situated in relation to the base support 304 is a junction box 301. The junction box 301 serves as a protective covering or enclosure for an aperture 320 in the roof 306 of the locomotive cab or locomotive body panel. The junction box 301 may be adapted to route the wiring from the antennas 302 to their respective devices via a wire connection arrangement in the locomotive cab. The junction box 301 may include seals at both the aperture 320 in the roof 306 of the locomotive (or locomotive body panel) and at the wiring entry from the removable plates to prevent water ingress into the locomotive cab. In another example, the aperture 320 in the roof 306 of the locomotive (or locomotive body panel) and/or the wiring entry may be potted. Additionally, the entire junction box 301 may be entirely potted.

As shown in this embodiment, the removable plates 314 may be sized and shaped to accommodate a plurality of different types of antennas 302, including but not limited to a cellular antenna 302A, a distributed power antenna 302B, a tri-band antenna 302C, a GPS antenna 302D, a head of train antenna, an end of train antenna, voice radio antenna (e.g., VHF voice antenna), WIFI or WLAN antenna 302E, digital cellular antenna, data radio antenna (e.g., a 220 MHz antenna), GSM-R antenna, electronic train management antenna, or the like. Because the plates 314 are removable, each antenna 302 may be rearranged to optimize its communication signal and may be easily replaced without removing another antenna 302 or either of the rails 308 of the base support 304. In this embodiment, the removable plates 314 are shown to be situated just below the top portion of each rail 308 of the base support 304. The removable plates 314 are preferably affixed to the rails 308 of the base support 304 using a plurality of mechanical fasteners 310B.

Figure 9:
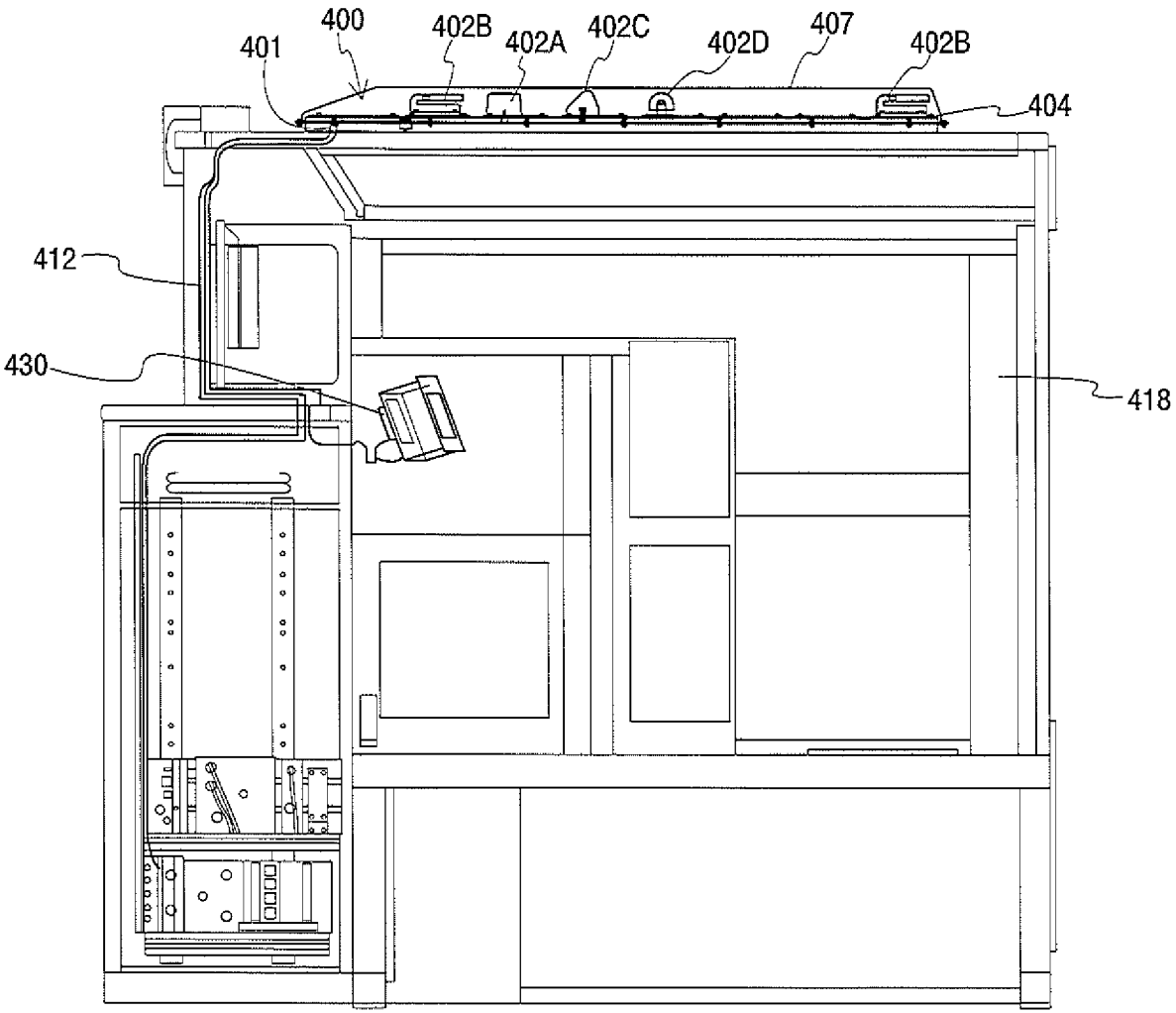
FIG. 9 is a side cross-sectional view of a locomotive cab including a second embodiment of the present invention modular antenna array.
Figure 10:
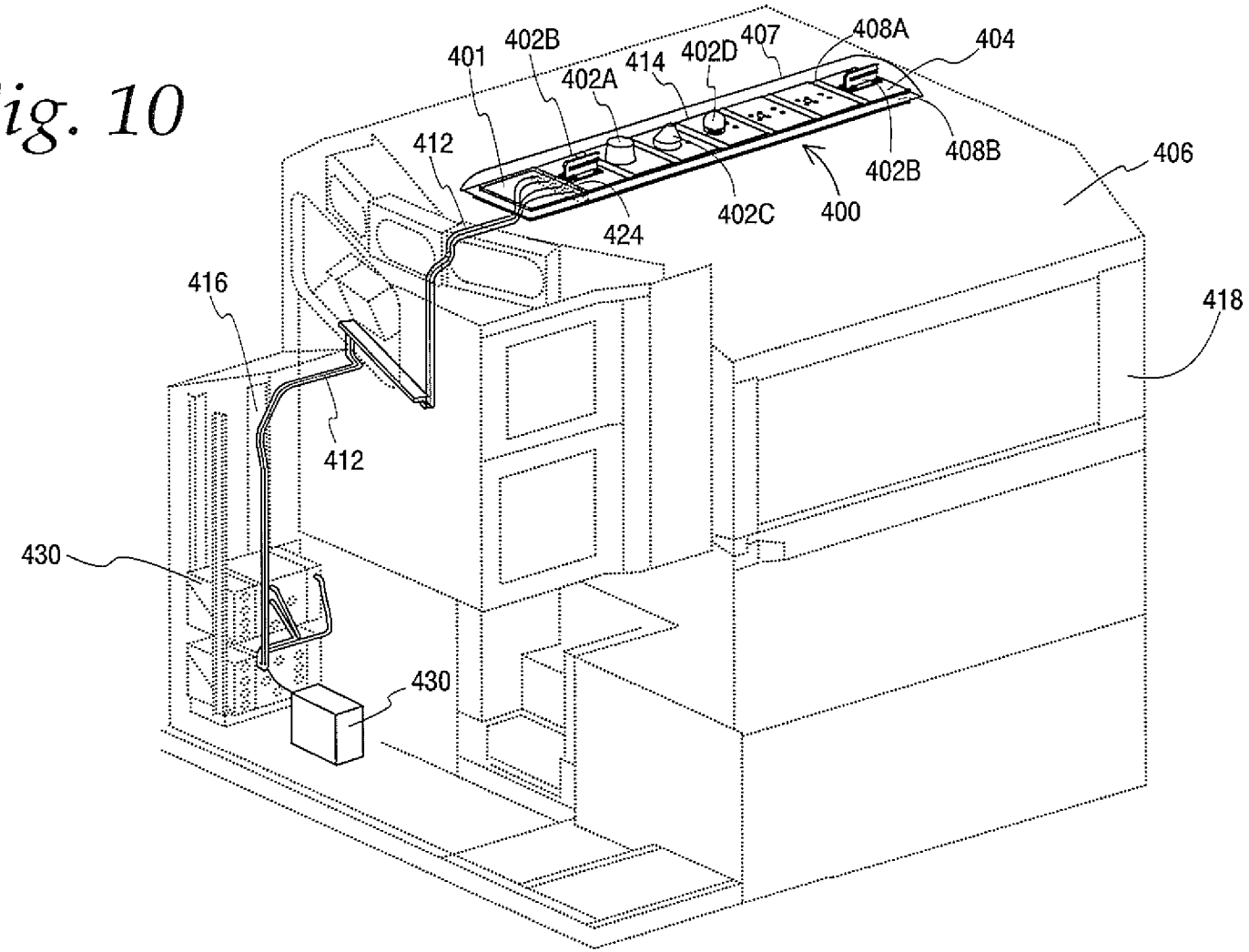
FIG. 10 is a perspective cross-sectional view of a locomotive cab including the second embodiment of the present invention antenna array.

FIGS. 9 through 15 illustrate a second embodiment of the present invention. This apparatus generally comprises a modular antenna array 400 including a base support 404 having a pair of rails 408 situated in parallel to one another. The base support 404 may be affixed to the roof 406 of the locomotive cab 418 as shown in FIGS. 9 and 10 or any other locomotive body panel (not shown) using a variety of fastening means including but not limited to welding, epoxy, mechanical fasteners, room temperature vulcanizing (RTV), or the like. The base support 404 may be constructed of a durable metal, fiberglass or other suitable material. Situated on the base support 404 is a plurality of removable plates 414, each being adapted to affix an antenna 402 thereto. The removable plates 414 may be constructed of a durable metal or other suitable material conducive for RF applications.

Figure 12:
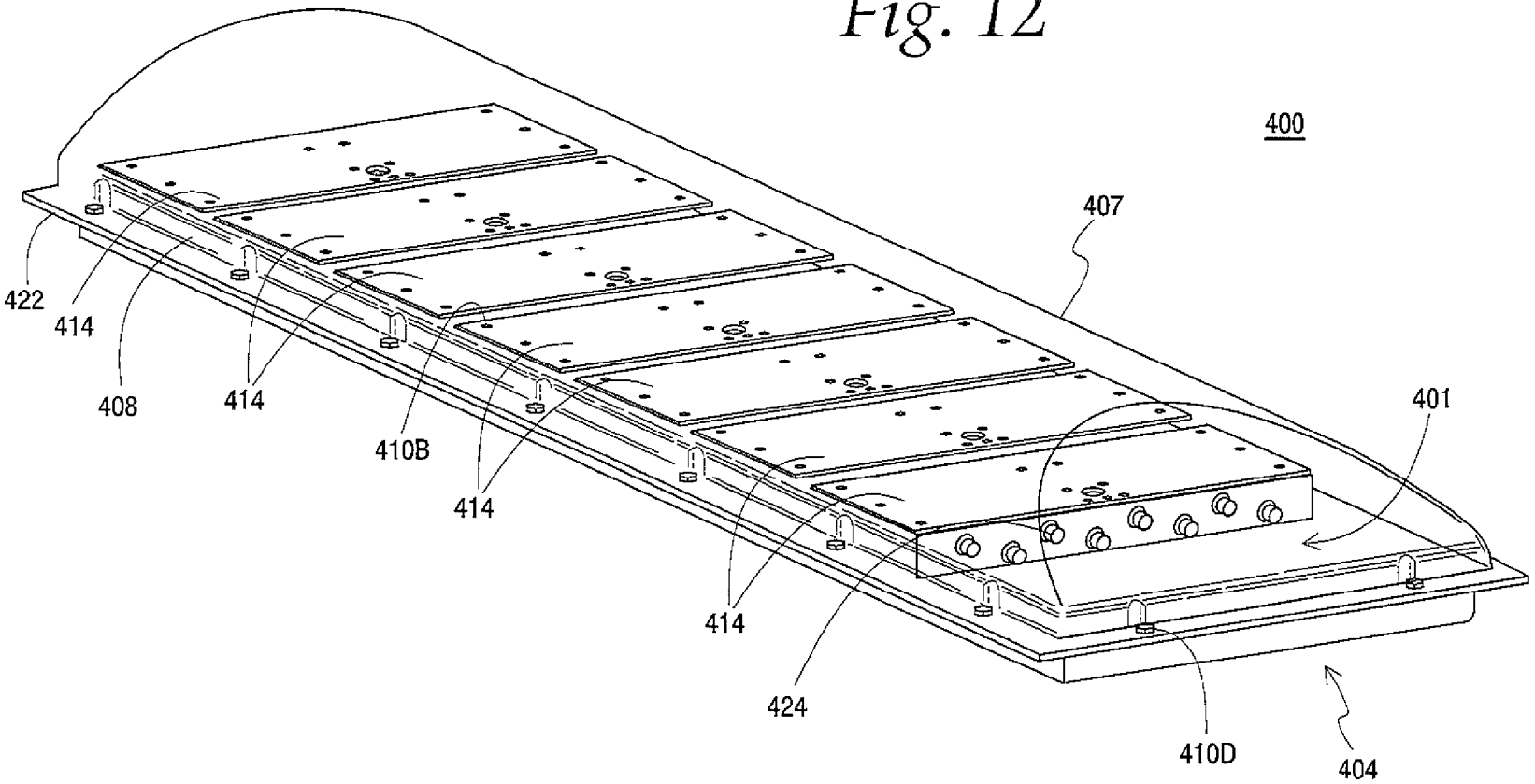
FIG. 12 is a perspective view of the second embodiment of the present invention modular antenna array.
Figure 14:
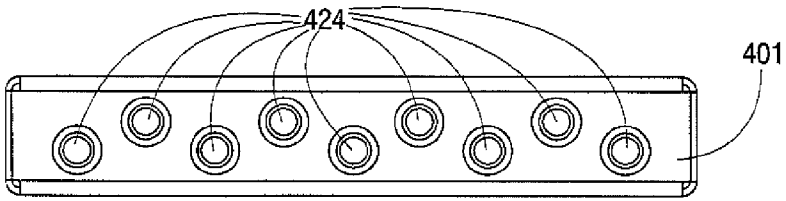
FIG. 14 is a side view the second embodiment of the present invention modular antenna array illustrating interconnects.
Figure 15:
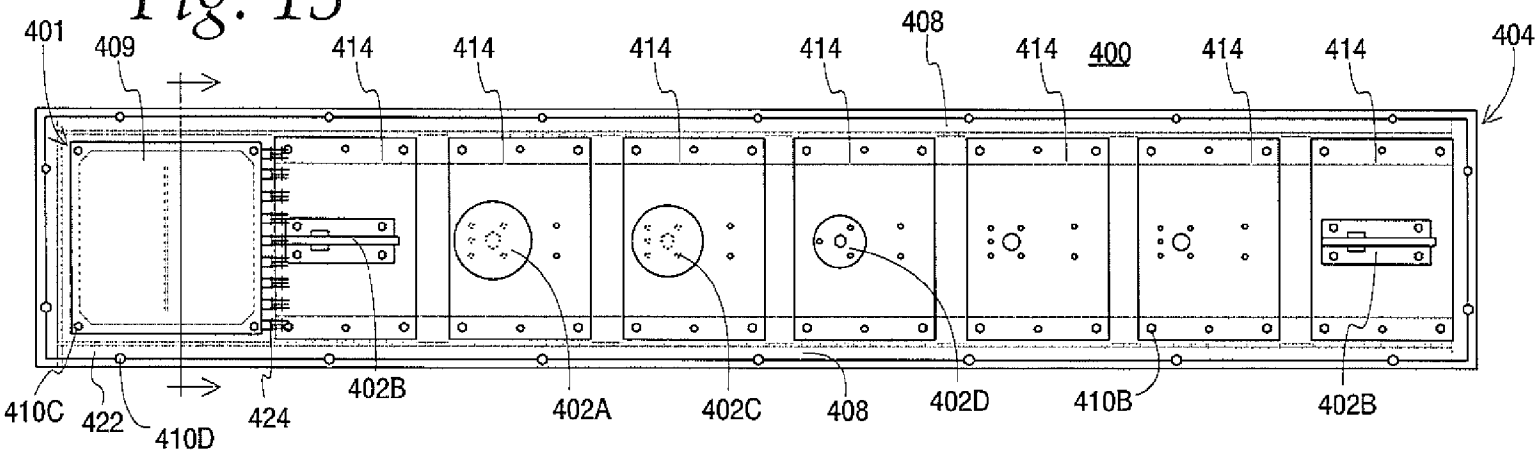
FIG. 15 is a top cross-sectional view of the second embodiment of the present invention modular antenna array.

Situated at one end of the base support 404 is a junction box 401. In this embodiment, the rails 408 of the base support 404 form the sidewalls of the junction box 401. In another embodiment (not shown), the junction box may be separate and apart from the base support. One end wall of the junction box 401 is preferably integral to the sidewalls of the junction box 401 as shown. The other end wall of the junction box 401 may include a plurality of interconnects 424, as shown in FIGS. 12 and 14-15, adapted to accommodate connections to the various wiring 412 of the antennas 402. The end wall of the junction box 401 having the plurality of interconnects 424 may be integral to the sidewalls of the junction box 401 or removable for maintenance purposes. The interconnects 424 may be any suitable type of RF interconnects 424 or any other connectors. For example, in one arrangement, the interconnects 424 may be raised from the roof of locomotive cab and generally situated parallel thereto. Accordingly, the interconnects 424 may accommodate the use of inline RF connectors. In one embodiment, the interconnects 424 are N-type RF connectors. In another embodiment, the interconnect is a sealed or water-resistant interconnect.

As shown in the various drawings and specifically in FIGS. 9 and 10, the interconnects accommodate a plurality of wires 412 from the junction box 401, through an aperture 420 in the roof 406 of the locomotive cab 418 (or locomotive body panel) and to the various devices 430 associated thereto via a wire connection arrangement 416. Accordingly, during installation or replacement of an antenna 402A-D, wiring 412 would only need to be replaced from the antenna 402A-D to the junction box 401, rather than from the antenna 402 to the devices within the locomotive cab 418 as with prior art systems. Because wiring 412 would not need to be replaced from the junction box 401 to the devices 430 within the locomotive cab 418, the aperture 420 in the roof 406 of the locomotive cab 418 (or locomotive body panel) may be potted or otherwise sealed to prevent water ingress. Moreover, the junction box 401 includes an additional protective cover 409 preferably affixed to the top walls of the junction box 401 using a plurality of fasteners 410C. The junction box 401 and its protective cover 409 may be constructed of a durable metal, fiberglass or other suitable material. A sealing gasket (not shown) may further be provided for an additional seal between the protective cover and the junction box.

As shown in this embodiment, the removable plates 414 may be adapted to accommodate a plurality of different types of antennas 402, including but not limited to a cellular antenna 402A, a distributed power antenna 402B, a tri-band antenna 402C, a GPS antenna 402D, a head of train antenna, an end of train antenna, voice radio antenna (e.g, VHF voice antenna), WIFI or WLAN antenna, digital cellular antenna, data radio antenna (e.g., a 220 MHz antenna), GSM-R antenna, electronic train management antenna, or the like. The removable plates may be also sized and shaped to accommodate the various antennas (not shown) and may include apertures of various shapes and sizes to accommodate mounting of various antenna bodies and wiring associated thereto. Although each removable plate 414 is shown to have separation between it and another plate 414, the removable plates 414 may be situated to touch another plate. Also, although each removable plate 414 is shown to accommodate only one antenna 402, each removable plate 414 may be further adapted to accommodate a plurality of antennas 402. Furthermore, a sealing gasket may be provided for a sealing arrangement between each removable plate 414 and the base support 404.

Because the plates 414 are removable, each antenna 402 may be rearranged to optimize its communication signal and may be easily replaced without removing another antenna 402 or either of the rails 408 of the base support 404. In this embodiment, the removable plates 414 are shown to be affixed to the top of each base support 404. The removable plates 414 are preferably affixed to the base supports 404 using a plurality of mechanical fasteners 410B. In this arrangement, the wiring 412 from the antenna 402 may run from the antenna 402 through the channel formed by the rails 408 of the base support 404 and to the interconnects 424 of the junction box 401. In one arrangement, the wiring 412 from the interconnects 424 of the junction box 401 to each antenna 402 may be a select length to accommodate interchangeability and rearrangement of the antennas 402. For example, each wire 412 may span the length of the base support 404 such that the wiring 412 need not be replaced during rearrangement of the antenna 402.

Figure 11:
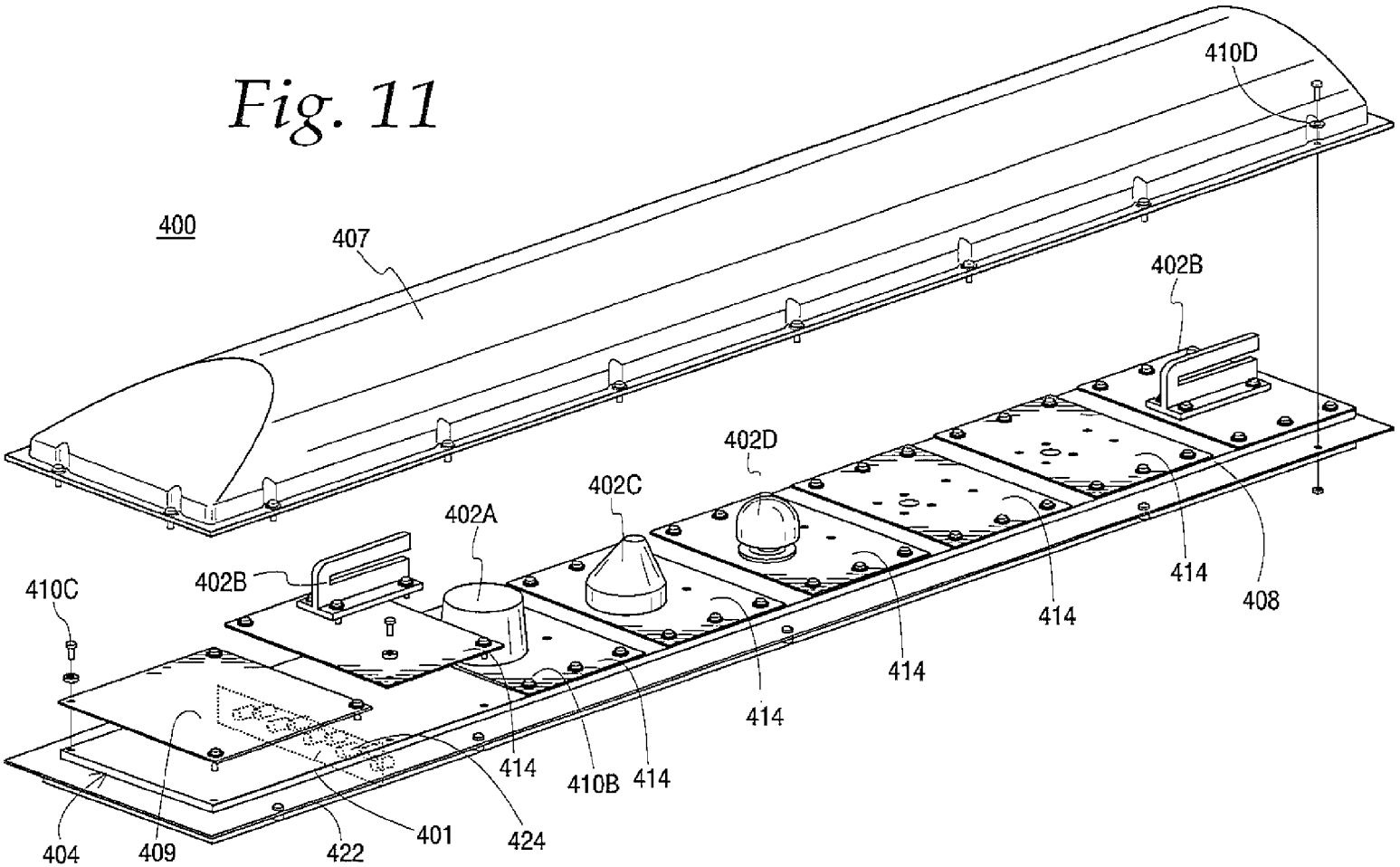
FIG. 11 is an exploded perspective view of the second embodiment of the present invention modular antenna array.
Figure 13:
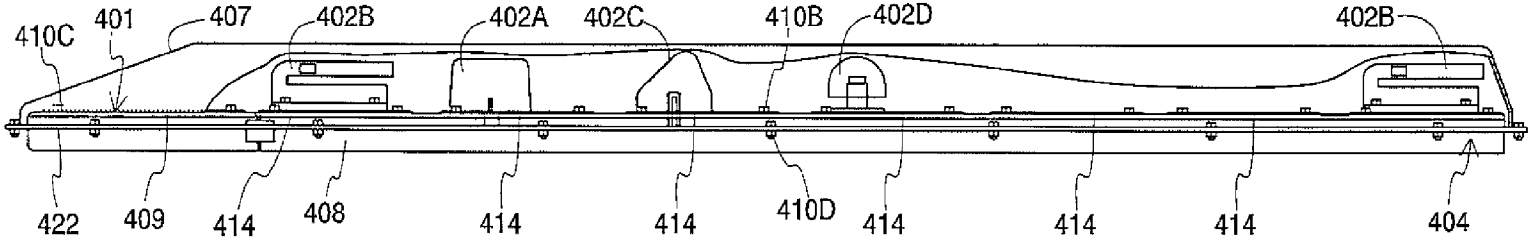
FIG. 13 is a side cross-sectional view of the second embodiment of the present invention modular antenna array.

As specifically illustrated in FIGS. 11-13, situated around the periphery of the base support 404, junction box 401 and end wall is a lip 422 for mounting a protective cover or radome 407 for the entire modular antenna array system. The lip 422 is generally elevated from the locomotive cab roof or locomotive body panel such that it accommodates a fastener, clip and enclosed nut arrangement 410D which may be easily removed as shown in FIG. 11. The cover or radome 407 may be fastened to the lip 422 in other suitable manners. With this arrangement, the protective cover or radome 407 is not affixed directly to the roof 406 of the cab 418 (or locomotive body panel), thereby further minimizing the likelihood of water ingress. A sealing gasket (not shown) may further be provided for a further sealing engagement between the lip and the cover. The cover 407 for the entire modular antenna array 400 system may be constructed of a durable fiberglass, polymer or other suitable material.

If constructed of metal material, the base support 404, the removable plates 414, junction box 401 and the metal fastener (or welding) arrangement provides for proper grounding of the system. If any part of the former arrangement is constructed of a non-metal material (e.g., a fiberglass or polymer), a grounding strap may be implemented to provide for adequate grounding. Additionally, an in-line grounding system may be provided in the connectors and wiring of the antenna. Also, any suitable system (e.g., an in-line system or catenary type system) may be provided to protect the apparatus from high voltage exposure.

Figure 16:
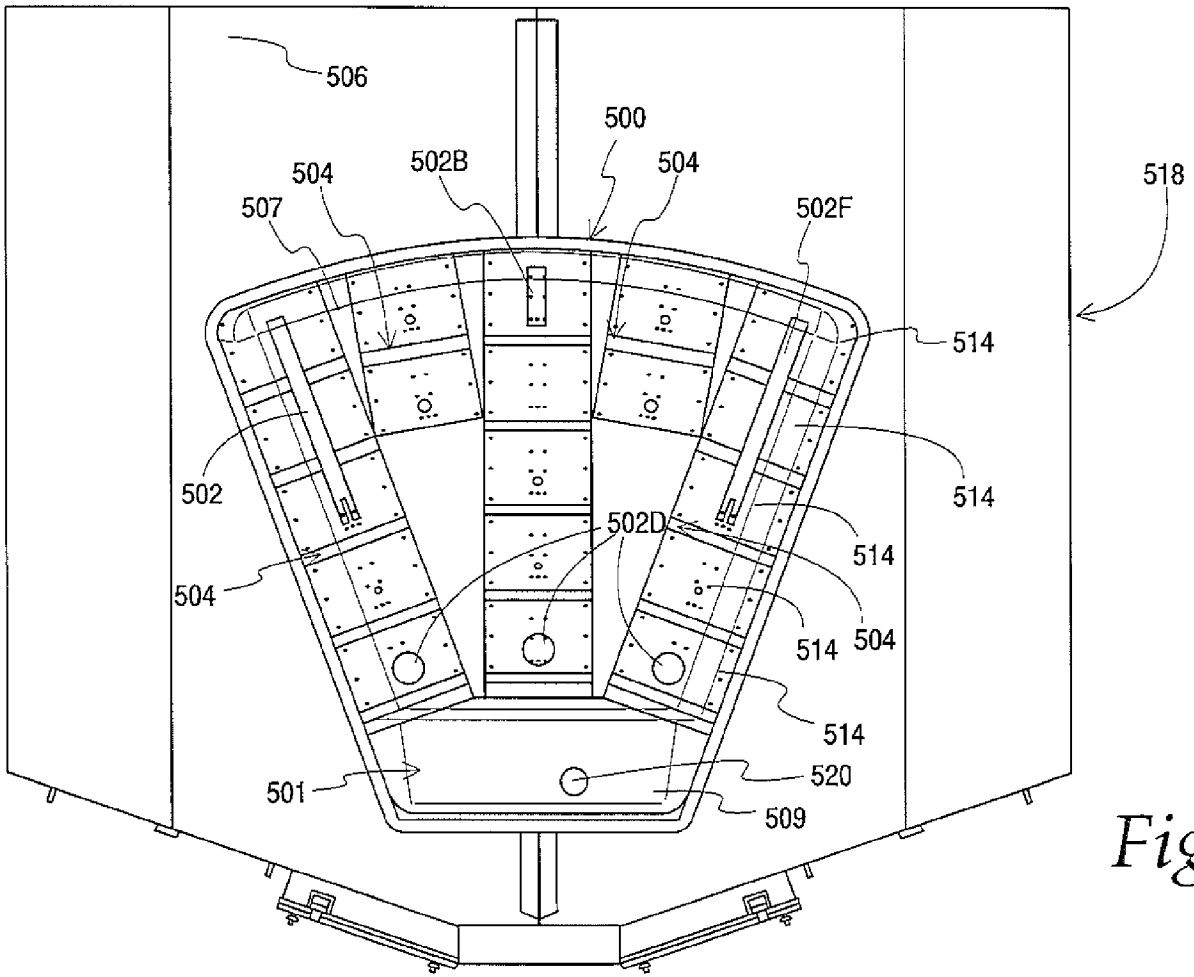
FIG. 16 is a top view of a locomotive cab including a third embodiment of the present invention modular antenna array.

In another arrangement, the modular antenna array may be comprised of a plurality of base supports to accommodate additional antennas 502B, 502D, 502F. In one example, as shown in FIG. 16, a modular antenna array 500 is illustrated having a plurality of base supports 504, the base supports 504 may be situated in a V shape and may have a junction box 501 at the vertex of the V, as shown in FIG. 16. For this embodiment, a protective cover or radome 507 may be provided for the entire or a portion of the system. In another example (not shown), the base supports may be situated parallel to one another and may have a single junction box extending between the base supports.

Although the arrangements are shown in the previous Figures to have a base support having separate rails, the base support may have a unitary construction, as shown in FIGS. 17-25. For example, the base support may be a unitary base plate 604.

FIGS. 17 to 25 illustrate yet another embodiment of the present invention. This apparatus generally comprises a modular antenna array 600 including a base plate 604. The base plate 604 may be affixed to the roof 606 of the locomotive cab 618 as shown in FIGS. 17-20 or any other locomotive body panel (not shown) using a variety of fastening means 610A, including but not limited to welding, epoxy, mechanical fasteners, room temperature vulcanizing (RTV), or the like. The base plate 604 may be constructed of a durable metal, fiberglass or other suitable material. In this embodiment, the base plate 604 is shaped such that it may support multiple modular antenna arrangements 600. For instance, in FIGS. 17 and 18, the base plate 604 supports three modular antenna arrangements 600 with a plurality of pillars 628, which carry removable plates 614 adapted to affix antennas 602 thereto.

Figure 17:
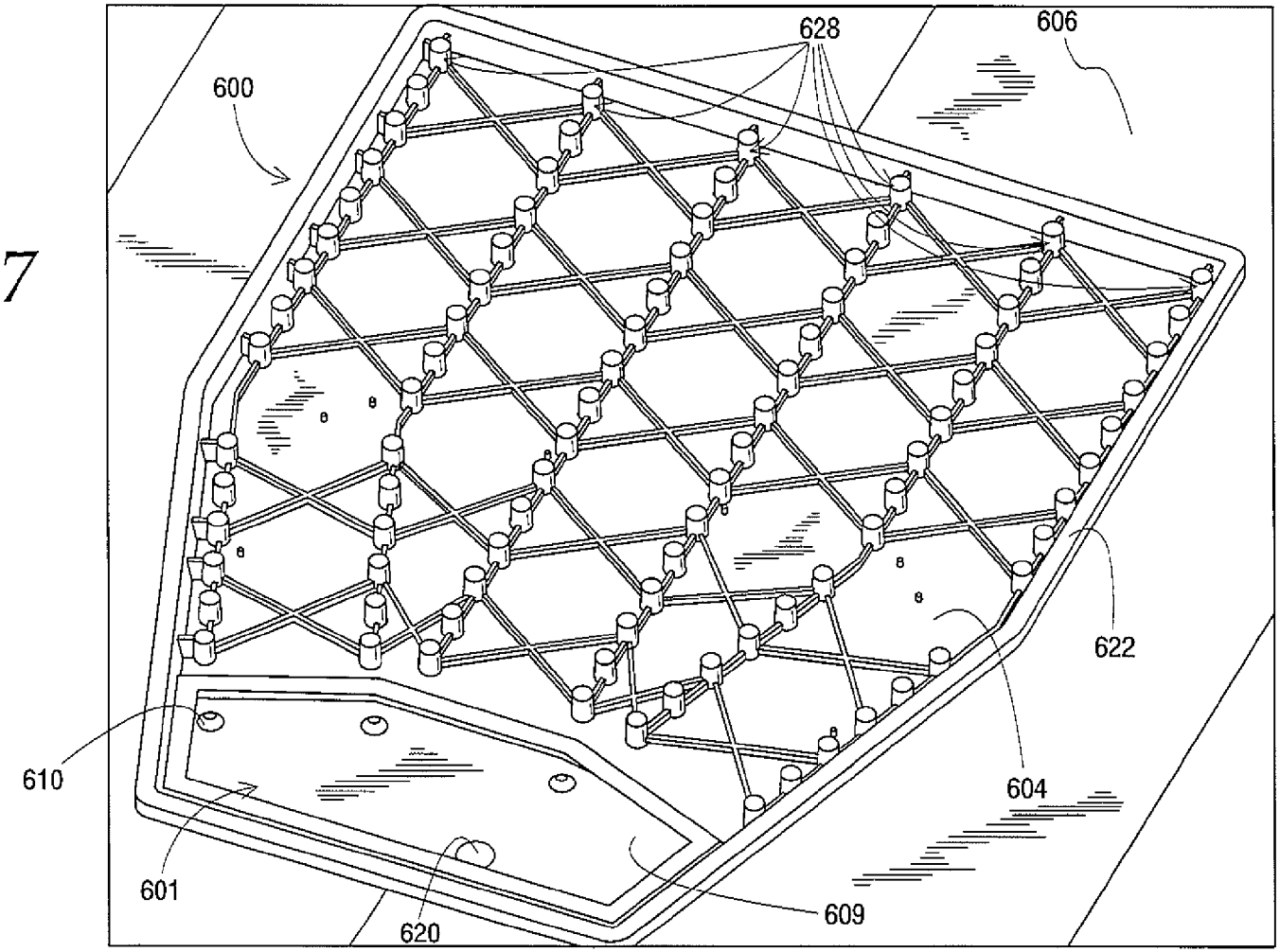
FIG. 17 is a top perspective view of an aspect of a fourth embodiment of the present invention modular antenna array including a plurality of pillars.
Figure 18:
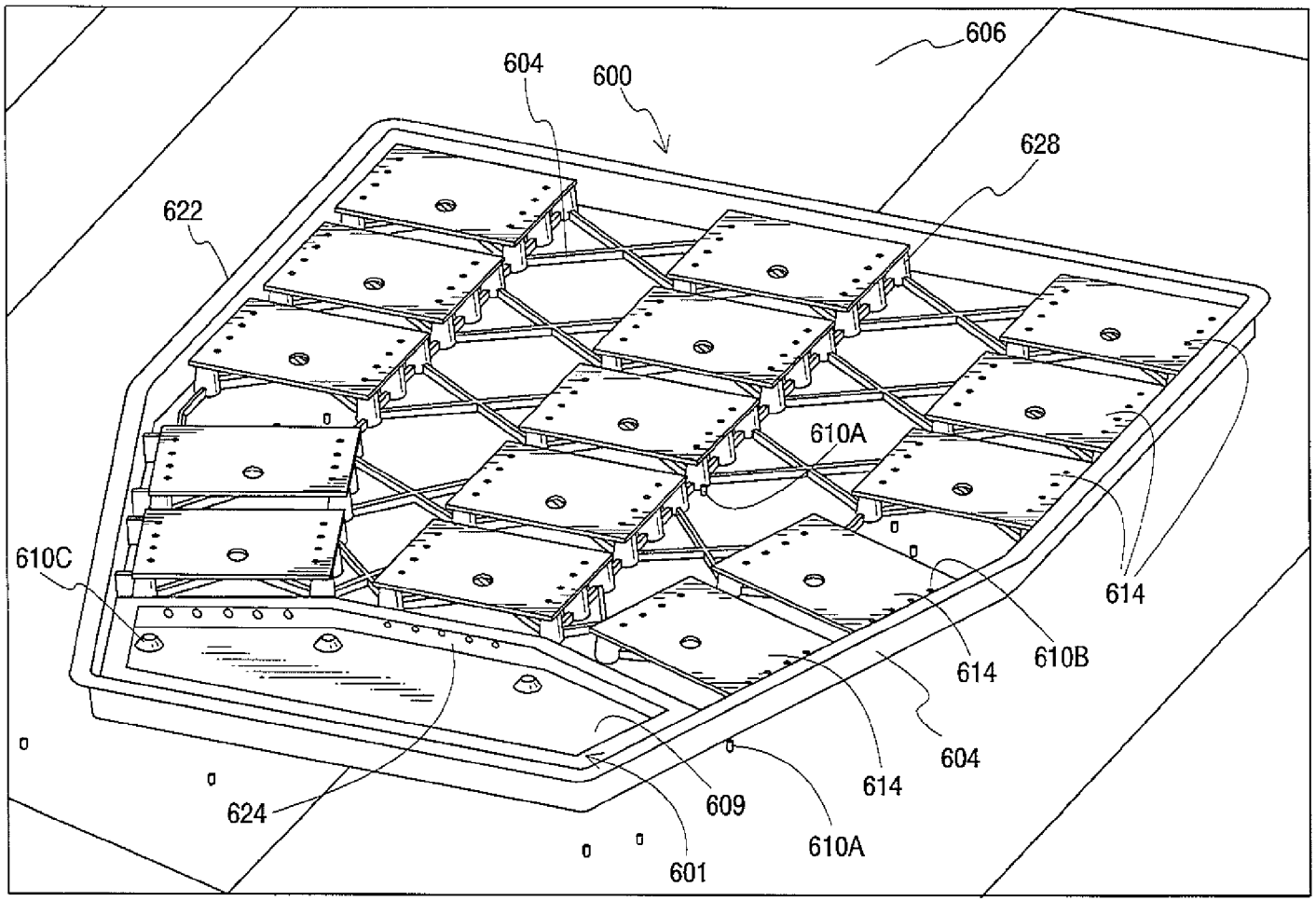
FIG. 18 is a top perspective view of the fourth embodiment of the present invention modular antenna array of FIG. 17 further including a plurality of removable plates.
Figure 19:
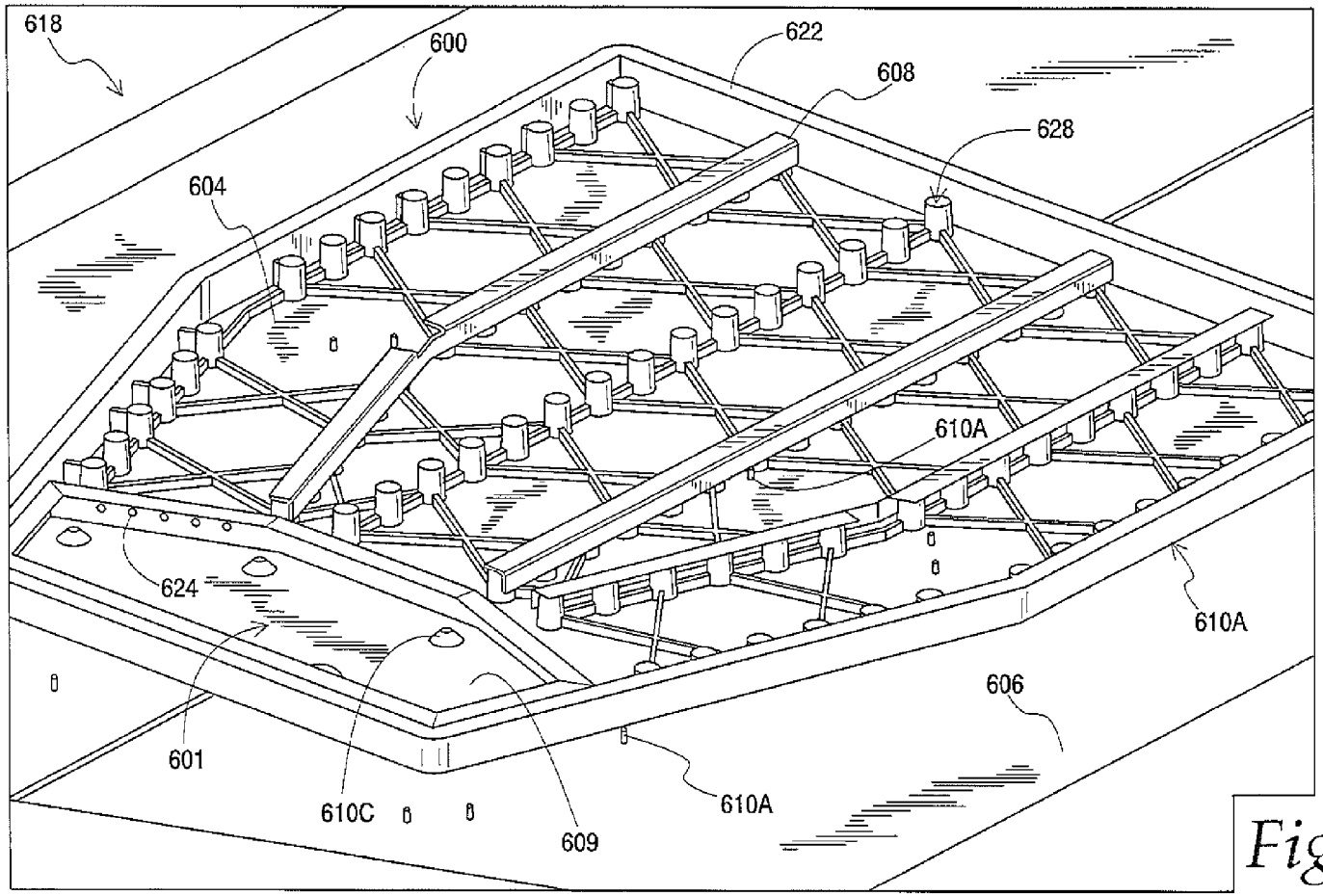
FIG. 19 is a top perspective view of the fourth embodiment of the present invention modular antenna array of FIG. 17 further including parallel rails.
Figure 20:
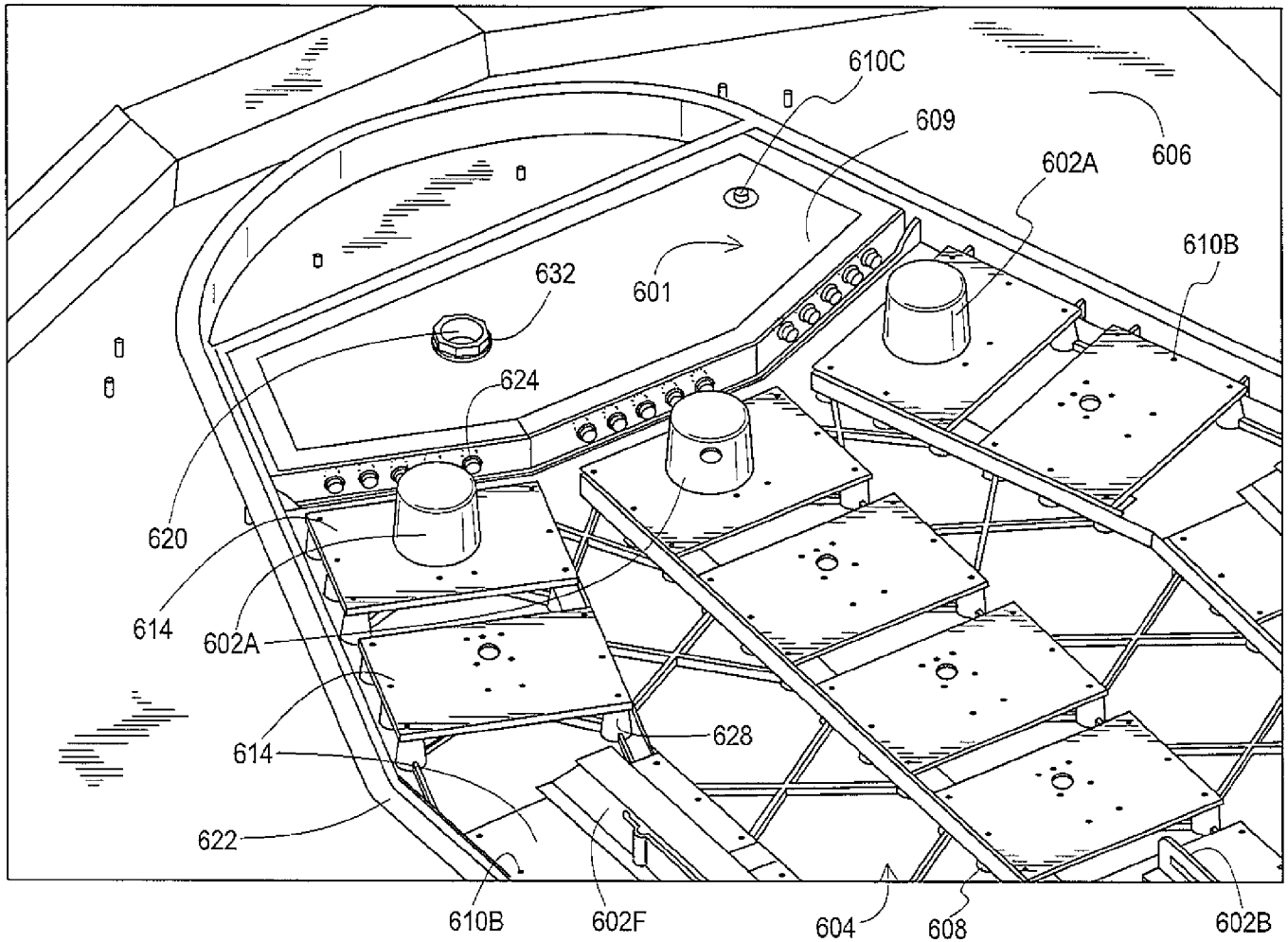
FIG. 20 is a top perspective view of the fourth embodiment of the present invention modular antenna array of FIG. 19 further including a plurality of removable plates.

Specifically, the base plate 604 includes a plurality of pillars 628 each being generally situated in parallel to another pillar, as shown in FIG. 17. As shown in FIG. 18, the pillars 628 may carry a plurality of removable plates 614, wherein each removable plate 614 is adapted to affix an antenna 602 thereto. Moreover, as shown in FIGS. 19 and 20, the pillars may alternatively support rails 608 for carrying a plurality of removable plates 614, each being adapted to affix an antenna 602 thereto. The removable plates 614 may be constructed of a durable metal or other suitable material conducive for RF applications.

Situated at one end of the base plate 604 is a junction box 601. In this embodiment, base plate 604 defines a separate section for forming the sidewalls of the junction box 601. In another embodiment (not shown), the junction box may be separate and apart from the base plate. One end wall of the junction box 601 is preferably integral to the sidewalls of the junction box 601 as shown. The other end wall of the junction box 601 may include a plurality of interconnects 624, as shown in FIGS. 18-20 and 22, adapted to accommodate connections to the various wiring 612 of the antennas 602. The end wall of the junction box 601 having the plurality of interconnects 624 may be integral to the sidewalls of the junction box 601 or removable for maintenance purposes. The interconnects 624 may be any suitable type of RF interconnects or other connectors. For example, in one arrangement, the interconnects 624 may be elevated from the roof 606 of locomotive cab 618 and generally situated parallel thereto. Accordingly, the interconnects 624 may accommodate the use of inline RF connectors. In one embodiment, the interconnects are N-type RF connectors. In another embodiment, the interconnect is a sealed or water-resistant interconnect.

The interconnects 624 accommodate a plurality of wires 612 from the junction box 601, through an aperture 620 defined in the roof 606 of the locomotive cab 618 (or locomotive body panel) and to the various devices associated thereto via a wire connection arrangement. Accordingly, during installation or replacement Of an antenna 602, wiring 612 would only need to be replaced from the antenna 602 to the junction box 601, rather than from the antenna 602 to the devices within the locomotive cab 618 as with prior art systems. Because wiring 612 would not need to be replaced from the junction box 601 to the devices within the locomotive cab 618, the aperture 620 in the roof 606 of the locomotive cab 618 (or locomotive body panel) may be potted Or otherwise sealed to prevent water ingress. Moreover, the junction box 601 includes an additional protective cover 609 preferably affixed to the top walls of the junction box 601 using a plurality of fasteners 610C. The junction box 601 and its protective, cover 609 may be constructed of a durable metal, fiberglass or other suitable material. A sealing gasket 632 is further provided for an additional seal between the base plate 604 and the locomotive cab roof 606. In an embodiment (not shown), the sealing gasket may be extended to further provide a seal between the junction box 601, the base plate 604, and the locomotive cab roof 606.

As shown in this embodiment, the removable plates 614 may be adapted to accommodate a plurality of different types of antennas 602, including but not limited to a cellular antenna 602A, a distributed power antenna 602B, a tri-band antenna, a GPS antenna, a head of train antenna, an end of train antenna, WIFI or WLAN antenna, voice radio antenna (e.g, VHF voice antenna) 602F, digital cellular antenna, data radio antenna (e.g., a 220 MHz antenna), GSM-R antenna, electronic train management antenna, or the like. The removable plates may be also sized and shaped to accommodate the various antennas (not shown) and may include apertures of various shapes and sizes to accommodate mounting of various antenna bodies and wiring associated thereto. Although each removable plate 614 is shown to have separation between it and another plate 614, the removable plates 614 may be situated to touch another removable plate 614. Also, although each removable plate 614 is shown to accommodate only one antenna 602, each removable plate 614 may be further adapted to accommodate a plurality of antennas. Furthermore, a sealing gasket (not shown) may be provided for a sealing arrangement between each removable plate 614 and the base plate 604.

Because the plates 614 are removable, each antenna 602 may be rearranged to optimize its communication signal and may be easily replaced without removing another antenna 602, the pillars 628 or either of the rails 608 of the base plate 604. In this embodiment, the removable plates 614 are shown to be affixed to the top of each base plate 604. the removable plates 614 are preferably affixed to the base plate 604 using a plurality of mechanical fasteners 610B. In this arrangement, the wiring 612 from each antenna 602 may run from the antenna 602 through the channel formed by the pillars 628 or rails 608 of the base plate 604 and to the interconnects 624 of the junction box 601. In one arrangement, the wiring 612 from the interconnects 624 of the junction box 601 to each antenna 602 may be a select length to accommodate interchangeability and rearrangement of the antennas 602. For example, each wire 612 may span the length of the base plate 604 such that the wiring 612 need not be replaced during rearrangement of the antenna 602.

Figure 21:
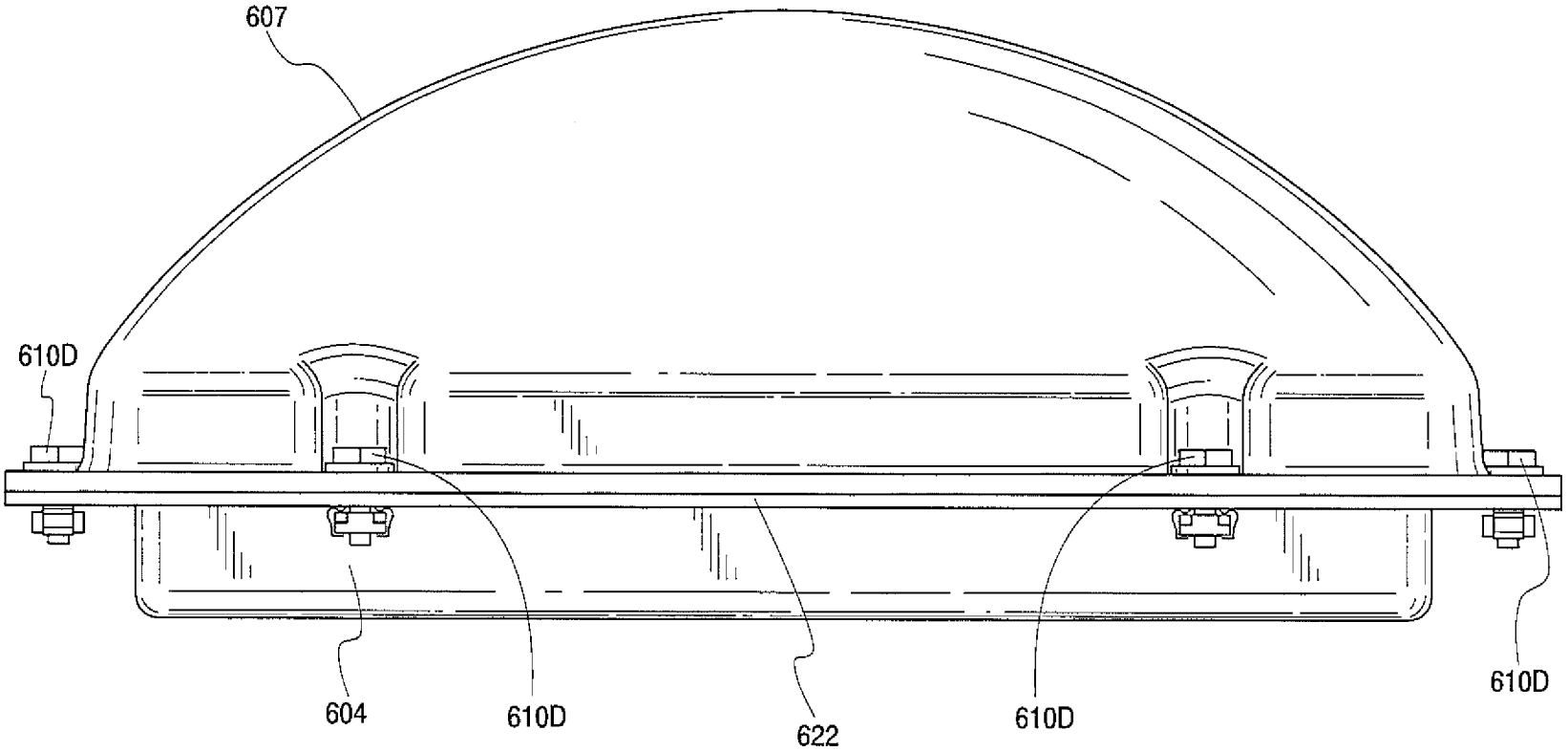
FIG. 21 is a side view of the fourth embodiment of the present invention modular antenna array including a cover.
Figure 22:
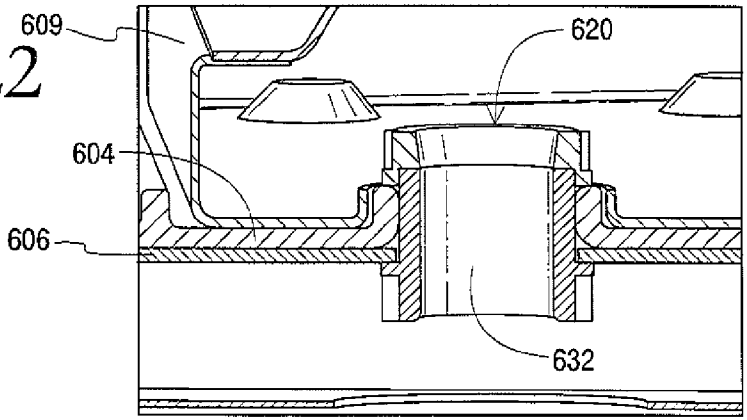
FIG. 22 is a cross-sectional view of an aspect of the fourth embodiment of the present invention modular antenna array.
Figure 23:
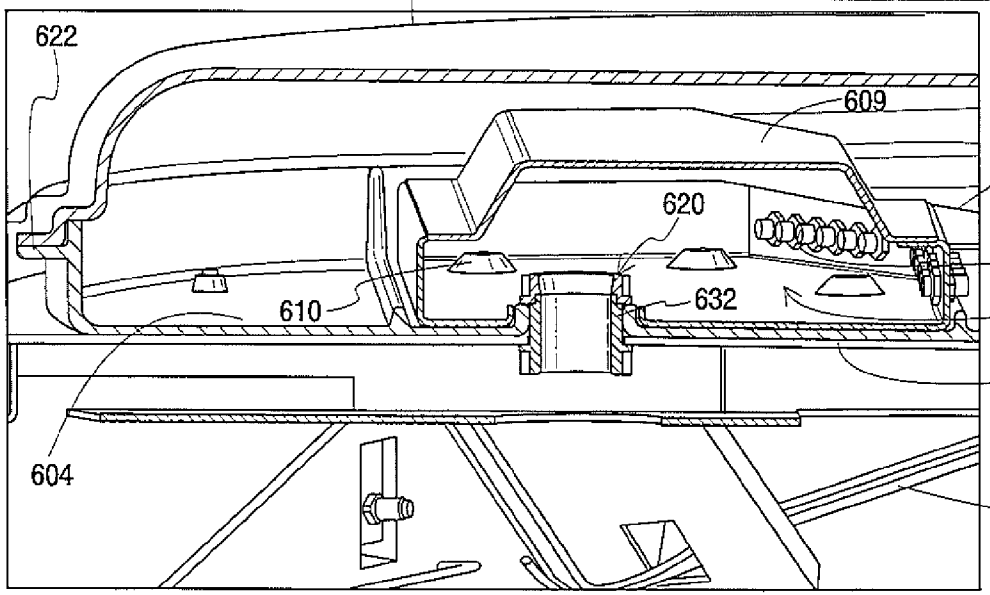
FIG. 23 is a cross-sectional view of the fourth embodiment of the present invention modular antenna array.

Situated around the periphery of the base plate 604, junction box 601 and end wall is a lip 622 for mounting a protective cover or radome 607 for the entire modular antenna array system. The lip 622 is generally elevated from the locomotive cab roof or body panel such that it accommodates a fastener, clip and enclosed nut arrangement 610D which may be easily removed as shown in FIG. 21. The cover or radome 607 may be fastened to the lip 622 in other suitable manners. With this arrangement, the protective cover or radome 607 does not need to be affixed directly to the roof 606 of the cab 618 (or locomotive body panel), thereby further minimizing the chances of water ingress. As shown in FIGS. 22 and 23, a sealing gasket may further be provided for a further sealing engagement between the lip 622 and the cover 607. The cover 607 for the entire modular antenna array 600 system may be constructed of a durable fiberglass, polymer or other suitable material.

Figure 24:
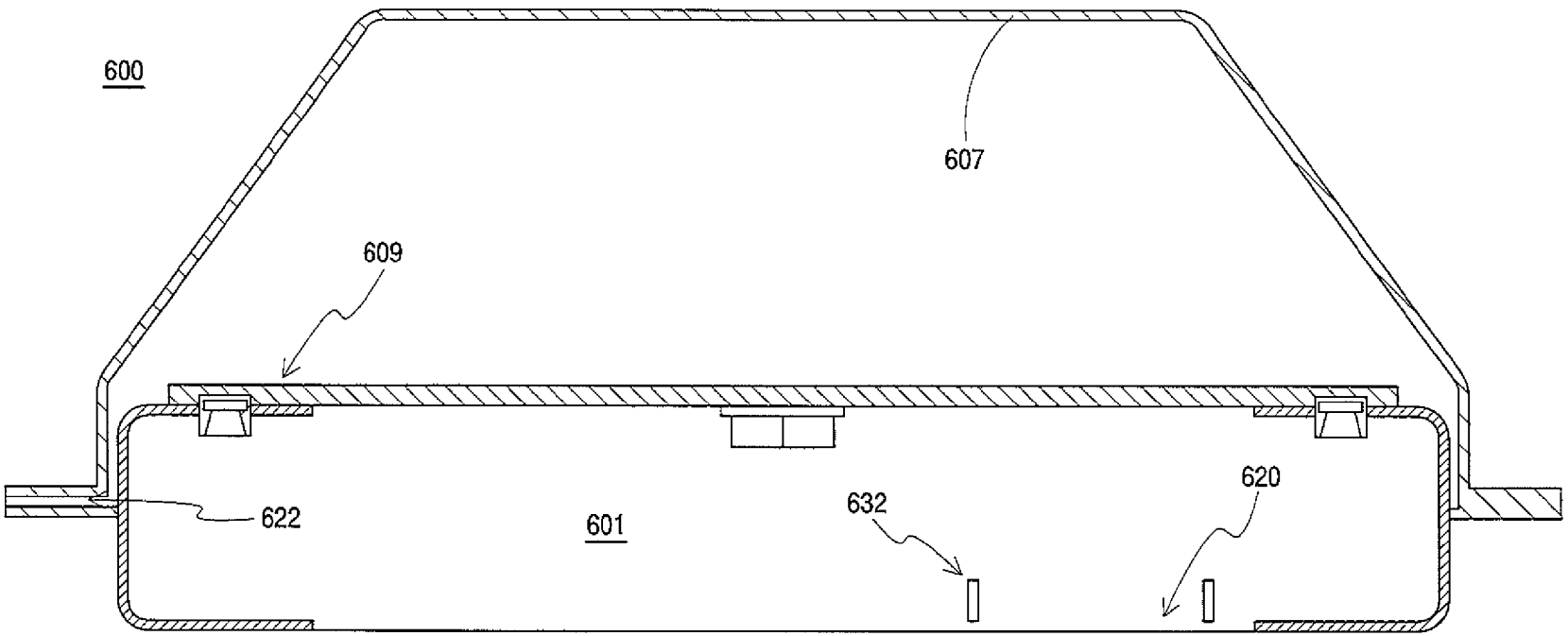
FIG. 24 is another cross-sectional view of the fourth embodiment of the present invention modular antenna array.

In this embodiment, the modular antenna array 600 provides three barriers to water ingress into the locomotive cab 618, as illustrated in FIGS. 22-24. In contrast to the prior art systems, this arrangement only defines a single aperture 620 in the locomotive cab roof 606. This aperture is located inside the junction box 601. The first barrier of protection from the environment is the cover or radome 607 of the modular antenna array. Additionally provided is a cover for the junction box 609, which protects the aperture 620 from water ingress. Thirdly, a sealing gasket 632 is further provided for an additional seal between the base plate 604 and the locomotive cab roof 606. In an embodiment (not shown), the sealing gasket may be extended to further provide a seal between the junction box 601, the base plate 604, and the locomotive cab roof 606. Additionally, the lip 622 where the radome 607 engages the base plate 604 provides for additional protection in that it deflects water from penetrating the modular antenna array 600. Therefore, because the present invention modular antenna array 600 provides a plurality of barriers to water ingress, damage to the devices of the locomotive cab 618 is prevented.

If constructed of metal material, the base plate 604, the removable plates 608, junction box 601 and the metal fastener 610 (or welding) arrangement provides for proper grounding of the system. If any part of the former arrangement is constructed of a non-metal material (e.g., a fiberglass or polymer), a grounding strap may be implemented to provide for adequate grounding. Additionally, an in-line grounding system may be provided in the connectors and wiring of the antenna. Also, any suitable system (e.g., an in-line system or catenary type system) may be provided to protect the apparatus from high voltage exposure.

Figure 25:
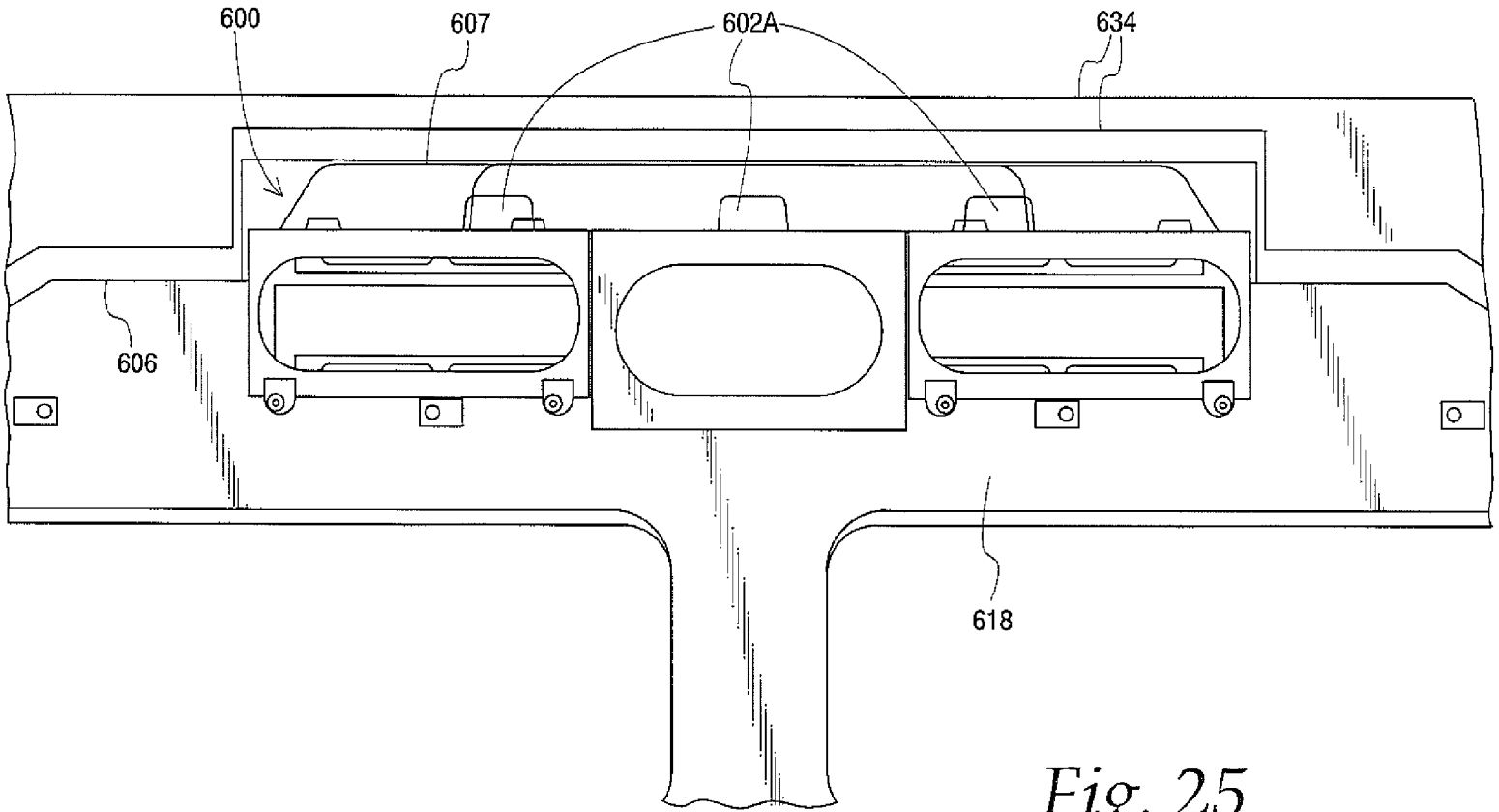
FIG. 25 is a front side view of a locomotive cab including any of the embodiments of FIGS. 6-24 of the present invention modular antenna array.

As shown in FIG. 25, the cover 607 of the modular antenna array 600 is well below the clearance range 634 necessary to avoid making contact with tunnels the locomotive may pass through.

In yet another arrangement, the present invention arrangements may be situated on any body portion of the locomotive, rather than on the roof of the locomotive cab.

The various embodiments of the present invention illustrate antenna arrangements which are modular in design. Specifically, the antenna arrangements include components which may be standardized to accommodate a variety of different antennas commonly used with locomotives. For example, each removable plate may accommodate a number of different types of antennas. Furthermore, these plates are sized and shaped such that the antennas may be interchanged or arranged easily. In another aspect, the antennas are arranged and mounted onto a body panel of the locomotive and protected under a single protective cover. In this way, the modular design provides the ability to easily mount, arrange, rearrange, replace and repair a plurality of different locomotive antennas.

While this invention has been described with reference to certain illustrative aspects, it will be understood that this description shall not be construed in a limiting sense. Rather, various changes and modifications can be made to the illustrative embodiments without departing from the true spirit, central characteristics and scope of the invention, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law.

What is claimed is:

1. An antenna array for a body panel of a locomotive, comprising:

a first base support forming a first channel on the body panel of the locomotive cab;

a second base support situated near the first base support, the second base support forming a second channel on the body panel of the locomotive cab, wherein the first and second base supports form a V-shaped arrangement;

a plurality of removable plates on the first and second base supports for mounting antennas, wherein wiring from each antenna extends from its respective removable plate through one of the first and the second channels.

2. The antenna array of claim 1, wherein the first and second base supports comprise elongated parallel structures situated above the body panel of the locomotive cab.

3. The antenna array of claim 2, wherein the removable plates extend between the elongated parallel structures.

4. The antenna array of claim 2, wherein the removable plates are situated on top of the elongated parallel structures.

5. The antenna array of claim 1, further comprising a junction box situated near the first base support.

6. The antenna array of claim 5, wherein the junction box includes a plurality of interconnects for connecting the wiring of each antenna to wiring of a device in the locomotive.

7. The antenna array of claim 5, wherein the junction box provides a protective covering for an aperture formed in the body panel of the locomotive.

8. The antenna array of claim 7, wherein the junction box includes potting material formed within the aperture formed in the body panel of the locomotive.

9. The antenna array of claim 5, wherein the junction box is integral to the first base support.

10. The antenna array of claim 1, further comprising a plurality of interconnects situated near the first base support for connecting the wiring of each antenna to wiring of a device in the locomotive.

11. The antenna array of claim 1, further comprising a lip about the periphery of the first base support.

12. The antenna array of claim 11, further comprising a cover affixed to the lip.

13. The antenna array of claim 12, wherein the cover is affixed to the lip with a fastener and an enclosed nut.

14. The antenna array of claim 1, further comprising a cover affixed about the periphery of the first base support.

15. The antenna array of claim 1, wherein each antenna is selected from a group consisting of a distributed power antenna, a GPS antenna, a cellular antenna, a head of train antenna, an end of train antenna, voice radio antenna, WIFI antenna, WLAN antenna, digital cellular antenna, data radio antenna, GSMR antenna, a tri-band antenna, and electronic train management antenna.

16. The antenna array of claim 15, wherein the removable plates are sized and shaped to accommodate the selected antenna.

17. The antenna array of claim 15, wherein the removable plates form apertures therein of various shapes and sizes to accommodate the selected antenna.

18. The antenna array of claim 1, further comprising a junction box in relation to the vertex of the V-shaped arrangement.

* * * * *